US009771638B2

(12) United States Patent
Furuhashi et al.

(10) Patent No.: US 9,771,638 B2
(45) Date of Patent: Sep. 26, 2017

(54) COLD-ROLLED STEEL SHEET

(71) Applicant: NIPPON STEEL & SUMITOMO METAL CORPORATION, Tokyo (JP)

(72) Inventors: Seiji Furuhashi, Tokyo (JP); Jun Haga, Tokyo (JP); Takayuki Nishi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/047,990

(22) Filed: Feb. 19, 2016

(65) Prior Publication Data

US 2016/0168669 A1 Jun. 16, 2016

Related U.S. Application Data

(60) Division of application No. 12/554,365, filed on Sep. 4, 2009, now Pat. No. 9,340,860, which is a (Continued)

(30) Foreign Application Priority Data

Mar. 5, 2007 (JP) ..... 2007-054511
Oct. 9, 2007 (JP) ..... 2007-263481

(51) Int. Cl.

| | |
|---|---|
| ***C22C 38/14*** | (2006.01) |
| ***C22C 38/04*** | (2006.01) |
| ***C22C 38/12*** | (2006.01) |
| ***C23C 2/06*** | (2006.01) |
| ***C23C 2/28*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C22C 38/14* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C23C 2/06* (2013.01); *C23C 2/28* (2013.01)

(58) Field of Classification Search

CPC ..... C22C 38/04; C22C 38/28; C22C 38/14
See application file for complete search history.

(56) References Cited

FOREIGN PATENT DOCUMENTS

| | | |
|---|---|---|
| CN | 1289375 | 3/2001 |
| CN | 1310770 | 8/2001 |

(Continued)

*Primary Examiner* — Weiping Zhu
(74) *Attorney, Agent, or Firm* — Clark & Brody

(57) ABSTRACT

A high strength cold-rolled steel sheet has excellent surface appearance and a composition consisting essentially of, in mass %, C: 0.0005-0.025%, Si: at most 0.2%, Mn: 0.3-2.5%, P: at most 0.15%, S: at most 0.02%, N: at most 0.006%, sol. Al: less than 0.005%, Ti: 0.005-0.05%, and Nb: 0.020-0.200% with the mass ratio (Nb/Ti) of the contents of Nb and Ti being at least 2, either boron at most 0.0020% or one or more of Cr, Mo, V, W, Cu, and Ni, each at most 1%, and a remainder of Fe and impurities. The sheet has excellent press formability and tensile strength by having an r value in a direction at 45° with respect to the rolling direction ($r_{45}$) of at least 1.80 and/or a mean r value ($r_m$) of at least 1.60, and a tensile strength of at least 340 MPa.

1 Claim, 3 Drawing Sheets

Related U.S. Application Data continuation of application No. PCT/JP2008/053843, filed on Mar. 4, 2008.

(56) References Cited

FOREIGN PATENT DOCUMENTS

| | | |
|---|---|---|
| JP | 10-46289 | 2/1998 |
| JP | 10-226843 | 8/1998 |
| JP | 11-323476 | 11/1999 |
| JP | 2000-303145 | 10/2000 |
| JP | 2002-12920 | 1/2002 |
| JP | 2004-225132 | 8/2004 |
| JP | 2004-315900 | 11/2004 |
| JP | 2006-002203 | 1/2006 |
| JP | 2007-231371 | 9/2007 |

COLD-ROLLED STEEL SHEET

This application is a Divisional of U.S. Ser. No. 12/554,365 filed on Sep. 4, 2009, which is a Continuation of PCT/JP2008/053843 filed on Mar. 4, 2008.

TECHNICAL FIELD

This invention relates to a cold-rolled steel sheet and a galvannealed steel sheet suitable for outer panels of automobiles such as side panels. It also relates to a process for the manufacture of these steel sheets. More particularly, the present invention relates to a cold-rolled steel sheet and a galvannealed steel sheet having a tensile strength of at least 340 MPa and having excellent press formability as evaluated by an r value in a direction at 45° with respect to the rolling direction of at least 1.80 and/or a mean r value of at least 1.60, as well as a process for their manufacture.

The present invention also relates to a cold-rolled steel sheet with excellent deep drawability which has an extremely low Al concentration and contains $TiO_x$-type inclusions and in which the proportion of $Al_2O_3$-type inclusions is restricted, and a manufacturing process in which molten steel refining conditions are limited.

BACKGROUND ART

In response to the need for safety during impacts and the need for reductions in the weight of automobiles, the strength not only of structural members of automobile bodies but also of steel sheets suitable for outer panels of automobiles such as side panels, hoods, doors, and fenders is being continuously increased. These steel sheets require not only a good surface appearance but also excellent press formability and particularly excellent drawability. From the past, it has been known that drawability has an extremely high correlation with the Rankford value (r value), which is a plastic strain ratio specified by JIS Z 2254, and that the higher the r value, the better is drawability. Therefore, this value has been widely employed as an index of drawability and has been widely used as an index in material design.

According to the investigations of the present inventors, blanks which are used for outer panels of automobiles such as side panels, hoods, doors, and fenders are among the largest blanks in size used for automotive parts, and nearly rectangular blanks which have been cut from a wide coil to keep the same width are subjected to pressing. In the case of a side panel, for example, the four corners of an opening which are difficult to press-form are positioned at 45° with respect to the rolling direction. If the r value in a direction at 45° with respect to the rolling direction (hereinafter referred to as $r_{45}$) of a steel sheet as a material being worked is low, wrinkles and cracks may easily develop. Accordingly, it is important for the steel sheet to have an increased value of $r_{45}$.

An effective method of producing a steel sheet having a high r value is to add a carbonitride-forming element such as Ti or Nb to an ultralow carbon steel having a C content of at most 30 ppm. Such a steel sheet called IF (interstitial free) steel is widely used generally as mild steel. Steel sheets having a high r value and high strength have been developed based on IF steel by adding solid solution strengthening elements such as Mn and P. However, solid solution strengthening elements are generally expensive and lead to cost increases of steel sheets. Therefore, Patent Document 1 discloses a technique using precipitation strengthening by NbC and TiC with the object of reducing solid solution strengthening elements. Patent Document 2 discloses a steel sheet having improved surface properties and mechanical properties by adding a suitable amount of Nb to a steel sheet containing 0.0040-0.01% of C so as to form fine precipitates of NbC and thereby refine the structure.

However, addition of Nb and Ti causes dense formation of fine precipitates of NbC and TiC or complexes thereof, i.e., (Nb,Ti)(C,N). Therefore, depending upon hot rolling conditions, grain growth sometimes becomes poor due to the pinning effect which obstructs the movement of grain boundaries at the time of recrystallization, thereby possibly causing a decrease in the r value.

For a high tensile strength cold-rolled steel sheet to which primarily Ti is added, it is difficult to have an increased $r_{45}$ value. When such a steel sheet is used for outer panels of automobiles, press cracks and wrinkles often develop, leading to an increase in pressing defects. In a high tensile strength cold-rolled steel sheet to which primarily Nb is added as described in Patent Document 2, since NbC precipitates more finely than TiC, high temperature annealing becomes essential. In order to avoid high temperature annealing, it is necessary to coarsen the precipitates, but the usual technique therefor, i.e., high temperature coiling at the time of hot rolling is inadequate.

Namely, in order to increase $r_{45}$ of a steel sheet, it is necessary to optimize the form of precipitates which are present therein and the ratio of the Nb and Ti contents.

Patent Document 3 discloses a cold-rolled steel sheet based on a mild steel having a low strength in which in order to improve the planar anisotropy of the r value, the steel has a decreased Al content and Mg and Ti are added such that the size and surface density of extremely fine oxides of Mg and Ti having a size of at most 0.1 μm contained in steel are controlled so as to densely disperse such oxides. This technique, however, refines oxides by the action of Mg, and it does not control precipitation of carbonitride-forming elements such as Nb and Ti which have a large effect on the r value. Furthermore, addition of Mg, which has extremely high reactivity, to molten steel at the time of melting so as to uniformly disperse its oxide is extremely difficult and causes problems from an operational standpoint.

Patent Document 4 discloses a steel sheet of an ultralow carbon steel having a reduced Al content and containing Ti and a process for its manufacture. This manufacturing process controls the composition of inclusions such that they are fine, they do not contain a locally crystallized hard phase, and they as a whole are readily deformed and crushed. As a result, the incidence of inclusion defects decreases, and the sol. Al content of the steel is decreased, so a steel having a low recrystallization temperature and high press formability can be obtained. However, there is no mention of the effect of inclusion defects on the surface appearance or formability, and in particular there is no mention of how to improve the r value, which is the most important index of drawability.

Patent Document 1: JP 10-46289 A1
Patent Document 2: JP 2000-303145 A1
Patent Document 3: JP 11-323476 A1
Patent Document 4: JP 10-226843 A1

DISCLOSURE OF INVENTION

Problem which the Invention is to Solve

The above-mentioned problems relate to press formability. With a Ti containing steel, another defect may occur during galvannealing (alloyed hot-dip galvanizing). Namely, the plated surface has an appearance having a streak pattern. This defect is thought to develop by the following mechanism.

A cast slab of such a steel contains finely dispersed Ti-based precipitates (TiC, $Ti_4C_2S_2$) therein. When the slab is reheated prior to hot rolling, the Ti-based precipitates form a solid solution beginning with the finest precipitates. At a temperature at which the precipitates cannot completely form a solid solution, coarsening of precipitates occurs by diffusion when the distance between the precipitates is small. If heating is nonuniform, depending upon the location, there are precipitates which do not go into solid solution or coarsen.

If hot rolling, cold rolling, and annealing are carried out in a state in which there is an uneven distribution of the size of precipitates, recrystallization behavior differs from one location to another due to the pinning effect which obstructs movement of grain boundaries. Therefore, the size of crystal grains varies from one location to another. The speed of alloying during galvannealing varies with the density of grain boundaries, so a difference in alloying behavior also develops in accordance with the above-described variation of crystal grain size, and a difference in surface irregularities develops in the galvannealed surface. During hot rolling and cold rolling, a state of uneven distribution of precipitate size is elongated in the rolling direction, and the difference in surface irregularities can be observed in the form of streaky irregularities running in the rolling direction in the plating appearance, and the surface appearance deteriorates. This deterioration in the surface appearance can sometimes be observed even after painting of a product, which is a major problem in the case of outer panels of automobiles where the defects can easily be observed by a user. In order to suppress such a defect, it is important to eliminate unevenness in the size of precipitates in a hot rolling step, and it is necessary to reduce the amount of fine precipitates and to coarsen precipitates so as to minimize the effect of variation in the behavior observed when precipitates form a solid solution.

The present invention was made in light of the current situation in which, as described above, a high-strength cold-rolled steel sheet and a high-strength galvannealed steel sheet having excellent press formability have not been developed. More particularly, it is an object of the present invention to provide a high-strength cold-rolled steel sheet and a high-strength galvannealed steel sheet which have a tensile strength of at least 340 MPa and which have an excellent surface appearance and excellent press formability as expressed by an extremely high r value in the direction of 45° with respect to the rolling direction ($r_{45}$) which are demanded of outer panels of automobiles such as side panels, hoods, doors, and fenders, as well as to provide a process for manufacturing these steel sheets.

Another object of the present invention is to provide a cold-rolled steel sheet which has an ultralow carbon content, an ultralow Al content, and high drawability and which can be stably manufactured by a mass production technique for steel, along with a process for manufacturing such a steel sheet. Specifically, an object is to provide a cold-rolled steel sheet of a steel having an ultralow carbon content and an ultralow Al content and high drawability and which, of the unavoidable nonmetallic inclusions which are formed during a large-scale steelmaking process, suppresses the amount of $Al_2O_3$-based inclusions which have an adverse effect and maintains the amount of $TiO_x$-based inclusions which are beneficial within a certain range, and a manufacturing process and particularly a refining process which can stably manufacture the above-described steel sheet using equipment used in a large-scale steelmaking process.

Means for Solving the Problem

In order to establish a process which can coarsen carbonitride precipitates even when Nb and Ti are added, the present inventors performed detailed investigations concerning the state of precipitation of precipitates and particularly concerning the relationship between oxides and carbonitrides, and they also investigated the effects of chemical composition on the state of precipitation.

Below, the results of tests which are the basis of the present invention will be explained. On a laboratory scale, steels which had a composition providing a tensile strength of the 440 MPa class and which were deoxidized with Al and Ti were prepared (only the sol. Al content of the chemical composition was varied). After the steels were subjected to hot rolling, cold rolling, and annealing using laboratory equipment, their mechanical properties as well as the form of oxides and carbonitrides present therein were investigated. In this description, percent with respect to the chemical composition of steel (either a steel sheet or molten steel) means mass percent unless otherwise specified.

As shown in FIG. 1, it was found that a steel in which Al was reduced and deoxidation with Ti was carried out had better formability and particularly a higher r value compared to a conventional aluminum killed steel.

As a result of further detailed investigation of this discovery, the following was learned.

In aluminum killed steels which have been commonly used from in the past and in which deoxidation is performed by adding Al, cluster-shaped $Al_2O_3$-type inclusions which are derived from the added Al do not affect the state of precipitation of (Nb,Ti)(C,N). In contrast, if deoxidation with Ti is carried out in a state with a low Al concentration, the formation of $Al_2O_3$-type inclusions is suppressed, and $TiO_x$-type inclusions are preferentially formed. Furthermore, (Nb,Ti)(C,N) complex precipitates are formed on the $TiO_x$-type inclusions which function as nuclei. As a result, the formation of (Nb,Ti)(C,N) having a form of fine precipitates is suppressed, leading to an effective increase in r value and in particular in the value of $r_{45}$ compared to a conventional aluminum killed steel.

As a result of further detailed investigation, it was found that a higher r value is obtained when the average number density of $TiO_x$ (inclusions) having a major axis with a length of at least 1 μm in a cross section of the thickness of a steel sheet product is at least $30/mm^2$.

$TiO_x$ as used herein is the generic designation for titanium oxides such as $TiO_2$, $Ti_2O_3$, and $Ti_3O_5$. This designation excludes carbonitrides of Ti and Nb as well as Mn oxides which are complex precipitates formed on a nucleus of $TiO_x$. When measuring the number of $TiO_x$ inclusions which are formed, for simplicity, the Ti concentration of each inclusion is determined using an energy dispersive x-ray microanalyzer (EDS) or the like, and those inclusions having a Ti concentration of at least 80 mass % as converted into $TiO_2$ are counted as $TiO_x$. When the $TiO_x$ concentration as converted into $TiO_2$ is less than 80 mass %, the phase which is formed is soft at a high temperature, or in other words it is amorphous and does not contain a crystal. Such a phase does not effectively function as a site on which a carbonitride is formed. Carbonitrides are formed so as to present on the surface of $TiO_x$, i.e., between the mother phase and inclusions by heterogeneous nucleation. $TiO_x$ inclusions normally contains Mn, Al, Ca, Si, and the like as unavoidable impurities.

The above-described preferred distribution of inclusions can be achieved with certainty by making sol. Ti (the content of acid-soluble Ti) at least 0.004%, whereby the r value increases. In FIG. 1, an open square mark shows the result when the average number density of $TiO_x$ having a major axis with a length of at least 1 μm was at least 30 per $mm^2$ and sol. Ti was at least 0.004%. In this case, the r value was higher than when sol. Ti was less than 0.004% (solid circle mark).

In addition, as a result of detailed investigation of the ratio of the contents of Nb and Ti, it was found that if the ratio of Nb/Ti is at least 2, the value of $r_{45}$ is further increased with an increase of mean r value. The reason for this phenomenon is not clear, but it is conjectured that among carbonitrides which form complex precipitates on $TiO_x$, Nb(C,N) is more effective than Ti(C,N) at increasing the value of $r_{45}$. It is also conjectured that grain refinement of hot-rolled steel sheet by Nb(C,N) also contributes to an increase in $r_{45}$.

As stated above, it was found that by suppressing the formation of fine precipitates and coarsening precipitates, nonuniformity in the size of precipitates which are formed at the time of reheating of a slab, for example, is decreased. As a result, recrystallization behavior and therefore alloying behavior after hot-dip galvanizing become uniform, leading to a decrease in the occurrence of streaky defects and hence to an improved surface appearance.

Based on the above-described experimental results on a laboratory scale, the use of equipment employed in a large-scale steelmaking process was investigated.

A steel as described above, which has an extremely low carbon content, which maintains the Al concentration at an extremely low level, and which contains a certain amount of an alloying element such as Ti which has affinity for oxygen can be stably obtained when using an experimental furnace such as a vacuum melting furnace or a practical furnace for small-scale production. However, according to the investigations of the present inventors, it is difficult to easily produce such a steel in a stable manner if steelmaking equipment in a large-scale steelmaking plant (steel works) like that described above is used.

As described below, a process for manufacturing an ultralow carbon steel in a large-scale steelmaking plant is particularly characterized by a molten steel refining process when compared to a normal steelmaking process.

In such a refining process, molten steel is initially subjected to rough decarburization by removing carbon in a steelmaking furnace such as a converter to form a low carbon molten steel having a carbon concentration from 0.04 mass % to 0.07 mass %, which is then tapped into a ladle in an undeoxidized state.

Next, the molten steel which was tapped off is subjected to vacuum decarburization in a refining step using a vacuum degassing apparatus to obtain an ultralow carbon molten steel having a carbon concentration of at most 0.025 mass %. Vacuum degassing is often carried out in an RH-type vacuum degassing apparatus (referred to below as an RH apparatus) which has a pair of snorkels (immersed pipes) to produce circulation of molten steel. In order to perform the decarburization reaction at this time, it is necessary for molten steel to contain oxygen which reacts with carbon. The oxygen concentration at this time is around 0.03 mass % to around 0.08 mass %.

Subsequently, alloy composition required for the steel is adjusted, and before or after this adjustment, typically Al deoxidation is carried out by the addition of Al in order to facilitate the adjustment of alloy composition and remove remaining oxygen. By such a process, an ultralow carbon Al-deoxidized steel is manufactured.

Decarburization refining to achieve an ultralow carbon concentration, control of the concentration of Al to an extremely low level which is a characteristic of the present invention, and adjustment of alloy composition are carried out in a vacuum degassing apparatus. If such a refining apparatus of vigorous stirring type as employed in vacuum decarburization is used, nonmetallic inclusions which usually have a particle diameter from several micrometers to several hundred micrometers are made suspended in the molten steel being refined. It was thought that depending upon the type of nonmetallic inclusions, the suspended inclusions had an adverse effect on the deep drawability of steel sheet made from the above-described ultralow carbon steel. As a result of diligent research on the requirements of nonmetallic inclusions which allow such a steel sheet to exhibit its inherent high drawability, the conditions therefor were found. In addition, steelmaking conditions were established for a mass production process for steel which can realize such conditions, whereby the present invention was completed.

In this respect, further explanation will be made below. In order to compensate for the temperature decrease of molten steel which occurs during the processing time needed for the above-described vacuum decarburization, heating of molten steel is often carried out before or after vacuum decarburization treatment. Specific techniques for carrying out this heating includes heating of molten steel by an oxidation reaction between a metal such as Al and oxygen gas, and electric heating in which an arc is generated from a graphite electrode so as to allow electric current to pass through molten steel and supply heat in the form of Joule heat.

The former technique, heating by an oxidation reaction causes a large amount of $Al_2O_3$-type inclusions produced by combustion of Al to be suspended in the molten steel. In addition, supplying oxygen gas increases the variable factors of the oxygen concentration in molten steel after decarburization treatment. Similarly, when Si is used for combustion, heating causes a large amount of $SiO_2$-type inclusions to be suspended in the molten steel.

With the latter technique employing electric heating, although suspension of a large amount of $Al_2O_3$-type inclusions or the like does not readily take place as in the former technique, there are problems such as the formation of slag-type inclusions by entrapment of ladle slag at the time of electric arc heating. In addition, problems such as an increase in running costs due to electric power consumption and electrode consumption and an increase in the overall refining time develop.

In the manufacture of a steel according to the present invention, it is necessary to adjust the content of alloying elements such as Si, Mn, and Nb and to add Ti to molten steel having a high oxygen concentration after decarburization. Si and Mn are elements which remove oxygen, namely, they are deoxidizing elements. However, compared to Al, they have a low affinity for oxygen, so there is a limit to the oxygen concentration which they can decrease. In addition, since their deoxidation speed is slow, a prolonged treatment time is required. As a result, variations develop in the state of deoxidation, adjustment of the content of elements such as Nb becomes difficult, the yield of Ti which is an expensive alloying element is decreased, and there is an adverse effect on the controllability of Ti.

In order to solve each of these problems at the same time, it was thought necessary not only to realize dispersion of $TiO_x$-type inclusions and the Ti concentration which are both included in the requirements of a steel according to the present invention, but also to clarify the form and allowable limits for $Al_2O_3$-type inclusions and slag-type inclusions which are thought to be unavoidably incorporated in the steel in the case of mass production of steel in order to find the conditions sufficient for steel to exhibit its inherent performance.

$TiO_x$ as used herein is the generic designation of Ti oxides in steel. Since Ti can be quadravalent or trivalent, Ti oxides can be present as $TiO_2$, $Ti_3O_5$, $Ti_2O_3$, or the like. There are also nonstochiometric compositions. Therefore, Ti oxides are expressed as $TiO_x$.

Next, an approach and theoretical methodology which can realize such conditions by mass production in a large-scale steelmaking plant were investigated. It was found that even if a method of heating up molten steel by addition of metallic Al followed by supply of oxygen gas is employed, it became possible to suppress the suspension of $Al_2O_3$-type inclusions to the necessary extent. Based on this finding, metallic Al was added to molten steel containing a large amount of oxygen obtained after vacuum decarburization in order to rapidly perform preliminary decrease of the oxygen concentration. Doing so made it easy to perform subsequent adjustment of Si and Mn and adjustment of alloying elements such as Nb. In this manner, a method was established which could both realize an ultralow Al concentration and carry out control of the Ti concentration and disperse $TiO_x$ inclusions by addition of Ti, whereby the present invention was completed.

The present invention, which was completed based on the above findings, is as follows.

The present invention is a cold-rolled steel sheet characterized by having a chemical composition consisting essentially of, in mass percent, C: 0.0005-0.025%, Si: at most 0.2%, Mn: 0.3-2.5%, P: at most 0.15%, S: at most 0.02%, N: at most 0.006%, sol. Al: less than 0.005%, Ti: 0.005-0.05%, and Nb: 0.020-0.200%, with the mass ratio of the contents of Nb and Ti (Nb/Ti) being at least 2, and a remainder of Fe and impurities, and by having an r value in a direction at 45° with respect to the rolling direction ($r_{45}$) of at least 1.80 and/or a mean r value ($r_m$) of at least 1.60 and having a tensile strength of at least 340 MPa.

A cold-rolled steel sheet according to the present invention preferably has an average number density of $TiO_x$ in a cross section of the thickness of the sheet of at least 30 per $mm^2$, and a sol. Ti content of at least 0.004%.

From another standpoint, the present invention is a cold-rolled steel sheet characterized by having the above chemical composition and having inclusions which satisfy the following inequalities (1) through (3):

$$N_{Ti} \geq 30/mm^2 \quad (1)$$

$$N_{Ti}/(N_{Ti}+N_{Al}) \geq 0.80 \quad (2)$$

$$N_{Ti}/N_{Total} \geq 0.65 \quad (3)$$

wherein, $N_{Ti}$: of inclusions having a major axis with a length of at least 1 μm in a vertical cross section parallel to the rolling direction, the average number density of those containing at least 50% of Ti oxides;

$N_{Al}$: of inclusions having a major axis with a length of at least 1 μm in a vertical cross section parallel to the rolling direction, the average number density of those containing at least 50% of Al oxides; and $N_{Total}$: the average number density of all oxide inclusions having a major axis with a length of at least 1 μm in a vertical cross section parallel to the rolling direction.

The chemical composition of the above-described cold-rolled steel sheet according to the present invention may contain, instead of a portion of Fe in the above-described chemical composition, B: at most 0.0020% and/or one or more elements selected from the group consisting of Cr: at most 1%, Mo: at most 1%, V: at most 1%, W: at most 1%, Cu: at most 1%, and Ni: at most 1%, all in mass percent.

The present invention is also a galvannealed steel sheet having a galvannealed plating layer on the surface of the above-described cold-rolled, steel sheet, wherein the above-described chemical composition according to the present invention has Si and P contents, in mass percent, of Si: at most 0.1% and P: at most 0.10%.

From another standpoint, the present invention is a process of manufacturing a cold-rolled steel sheet characterized by comprising the following steps (A)-(D):

(A) a step of hot rolling a steel ingot or slab having the above-described chemical composition according to the present invention and a temperature of 1100-1270° C. and completing hot rolling at a temperature of $Ar_3$-1000° C. to obtain a hot-rolled steel sheet;

(B) a step of coiling the hot-rolled steel sheet at a temperature of 400-700° C. to obtain a steel strip;

(C) a step of subjecting the hot-rolled steel sheet obtained by uncoiling the steel strip to pickling and then to cold rolling with a reduction of at least 50% to obtain a cold-rolled steel sheet; and (D) a step of subjecting the cold-rolled steel sheet to recrystallization annealing.

The above-described manufacturing process may be a process of manufacturing a cold-rolled steel sheet characterized by including a step of preparing the steel ingot or slab by converter refining and vacuum refining, wherein the vacuum refining comprises the following steps (E)-(G):

(E) a step of carrying out decarburization refining to decrease the carbon concentration of molten steel to at most 0.025 mass % using a vacuum degassing apparatus which circulates molten steel;

(F) a step of adding Al to the molten steel having a carbon concentration of at most 0.025 mass % so as to control the dissolved oxygen concentration of the molten steel to be at least 0.003 mass % to at most 0.018 mass %; and (G) a step of adding Ti to the molten steel having its dissolved oxygen concentration controlled to be at least 0.003 mass % to at most 0.018 mass % such that the sol. Ti content is at least 0.004 mass % to at most 0.04 mass %.

Between step (E) and step (F), there may be a step of adding Al and oxygen gas to the molten steel having a carbon concentration of at most 0.025 mass % to elevate the temperature of the molten steel by the heat of reaction.

It is also possible to manufacture a galvannealed steel sheet by carrying out a galvannealing (galvanizing and alloying) process on the surface of the cold-rolled steel sheet obtained by a manufacturing process according to the present invention including the above-described steps with the steel having the above-described chemical composition according to the present invention wherein the Si and P contents are, in mass %, at most 0.1% of Si and at most 0.10% of P.

Effects of the Invention

According to the present invention, a high-strength cold-rolled steel sheet and a high-strength galvannealed steel sheet having excellent press formability with a high r value and particularly a high value of $r_{45}$ suitable for outer panels of automobiles such as side panels, doors, and fenders can be manufactured. Therefore, the invention is extremely advantageous from an industrial standpoint.

This high-strength cold-rolled steel sheet can be used not only for working as it is but also as a substrate sheet for a surface treated steel sheet for use in working. Examples of such surface treatment are hot-dip metal plating such as hot-dip galvanizing and hot-dip Al plating, electroplating, and tinning.

A steel sheet according to the present invention has a suitable proportion of $TiO_x$ inclusions necessary for realizing good deep drawability to $Al_2O_3$ inclusions which are unavoidably contained when steel is manufactured in manufacturing equipment of a large-scale steelmaking plant. Therefore, high productivity can be stably realized while maintaining excellent deep drawability and high strength of steel.

In addition, with a manufacturing process according to the present invention, the above-described cold-rolled steel sheet having excellent deep drawability and high strength can be stably manufactured even when using a refining apparatus of the vigorous stirring type which is often employed in a large-scale steelmaking plant in order to increase productivity.

BEST MODE FOR CARRYING OUT THE INVENTION

Figure 1:
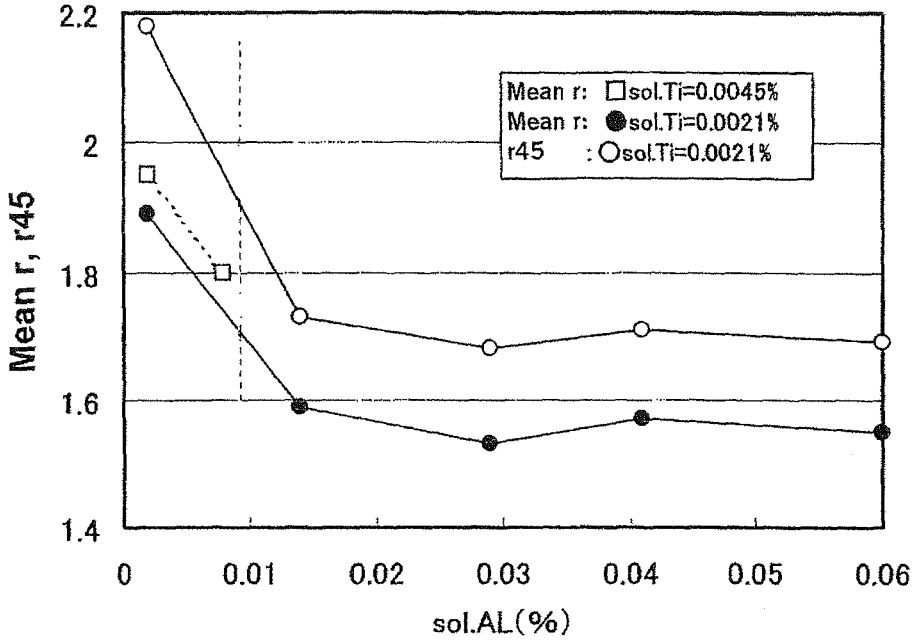
FIG. 1 is a graph showing the results of evaluation of the effect of the sol. Al content and the sol. Ti content on the mean r value and $r_{45}$.

1. Cold-Rolled Steel Sheet and Galvannealed Steel Sheet (1) Steel Composition

A steel according to the present invention has a chemical composition which contains the elements next described in (a) through (i), which satisfies the relationship described in (j), and which has a remainder consisting essentially of Fe and impurities.

(a) C: 0.0005-0.025%

C combines with carbide-forming elements such as Nb and Ti and forms carbides such as TiC or NbC or fine carbonitrides such as (Nb,Ti)(C,N) which are complex precipitates of the carbides. It is essential to optimize the C content in order to precipitate carbonitrides with a suitable volume percentage and to increase formability. The formation of carbonitrides provides a large effect of precipitation strengthening and makes it possible to obtain a high strength with no necessity to add a large amount of solid solution strengthening elements such as Mn, P, and Si. In addition, it is possible to decrease the amount of dissolved C and N at the time of recrystallization annealing, which has an improving effect on the r value of a product.

If the C content is less than 0.0005%, the cost of decarburizing molten steel becomes extremely high, and resistance to secondary working embrittlement may deteriorate. In addition, it may not be possible to obtain a sufficient tensile strength. On the other hand, if the C content exceeds 0.025%, the yield strength increases with elongation decreasing, and formability and particularly the r value decrease. Accordingly, the C content is 0.0005-0.025%. From the standpoints of better formability and particularly of ensuring the r value, the C content is preferably at most 0.01%.

(b) Si: at most 0.2%

Si is an element which is present in steel as an impurity. However, it is also an inexpensive element capable of solid solution strengthening. Therefore, Si can be contained with the object of increasing strength. However, Si has a deoxidizing action, and the effect of this action becomes significant when the content of sol. Al is low. If the Si content exceeds 0.2%, the formation of $TiO_x$ is obstructed by the deoxidizing action of Si. Accordingly, the Si content is at most 0.2%. It is preferably at most 0.15%, and an Si content of at most 0.10% is particularly preferred, since at this level, there is substantially no obstruction of the formation of $TiO_x$ by deoxidation with Si. When solid solution strengthening by Si is not necessary, the Si content is still more preferably at most 0.03%. When hot-dip metal plating is carried out on the surface of a cold-rolled steel sheet, if the Si content exceeds 0.1%, there is an increased possibility of Si having an adverse effect on plating quality. Therefore, when hot-dip metal plating is carried out on the surface of a cold-rolled steel sheet, the Si content is preferably at most 0.1%. An Si content of at most 0.05% is particularly preferred in this case.

Si is present in steel from the stage of crude steel, and it is necessary to perform appropriate refining treatment in order to decrease its content. Therefore, excessively decreasing the Si content leads to a decrease in productivity. Accordingly, the Si content is at least 0.003%. When it is desired to increase the strength of a steel sheet by the solid solution strengthening effect of Si, the Si content is preferably at least 0.02%.

(c) Mn: 0.3-2.5%

Mn has the effect of increasing the strength of a steel sheet by solid solution strengthening. If the Mn content is less than 0.3%, it may not be possible to achieve the desired high strength. On the other hand, if the Mn content exceeds 2.5%, the yield strength increases with elongation decreasing, and wrinkles and cracks develop more readily at the time of working. Therefore, the Mn content is 0.3-2.5%. In order to further increase the strength of a steel sheet by solid solution strengthening, the Mn content is preferably at least 0.4% and more preferably at least 0.8%. In order to obtain even better formability, the Mn content is preferably at most 2.0%.

(d) P: at most 0.15%

P is present in steel as an impurity, but it is useful as an element which can increase the strength of a steel sheet by solid solution strengthening while suppressing a decrease in the r value. Therefore, P can be contained with the object of increasing strength. However, if the P content exceeds 0.15%, the yield strength increases with elongation decreasing, leading to a deterioration in formability. Therefore, the P content is at most 0.15%. When galvannealing is performed on the surface of a cold-rolled steel sheet, a P content exceeding 0.10% may adversely affect the alloying ability of the steel sheet, thereby decreasing the adhesion of the plated layer, or cause a streaky pattern to appear on the plated surface due to segregation of P. Therefore, when the surface of a cold-rolled steel sheet is subjected to galvannealing, the P content is preferably at most 0.10%. More preferably it is at most 0.06%. The lower limit on the P content is preferably made at least 0.03% in order to ensure that the desired strengthening cab be achieved.

(e) S: at most 0.02%

S is present in a steel sheet as an impurity, and if its content is large, scale flaws may tend to develop easily, thereby markedly deteriorate the surface appearance of the steel sheet. Therefore, the S content is at most 0.02%. Preferably, it is at most 0.01%. More preferably it is at most 0.008%. There is no particular need to set a lower limit on the S content, but excessive desulfurization decreases productivity and leads to an increase in manufacturing costs, so the lower limit is preferably at least 0.002%.

(f) N: at most 0.006%

N is present in a steel sheet as an impurity. If too much N is present, yield strength increases to such an extent that surface strains develop easily, and the N dissolved in Fe causes surface defects such as stretcher strains to develop. Therefore, the N content is made at most 0.006%, Preferably it is at most 0.003%.

(g) sol. Al: less than 0.005%

Al is normally added for the purpose of deoxidation, but in the present invention, deoxidation is achieved primarily by Ti. Therefore, a high Al content is not necessary. In fact, if the Al content is excessive, the amount of $TiO_x$ inclusions which are important to the present invention decrease, and the amount of $Al_2O_3$-type inclusions, which do not affect the state of precipitation of (Nb,Ti)(C,N), ends up increasing. Therefore, the content of sol. Al is less than 0.005%. From the standpoint of fog inability, the sol. Al content is preferably at most 0.003%, since at this level, $TiO_x$ oxides are effectively formed. Since the r value increases as the sol. Al content decreases, there is no particular need to define a lower limit of Al. However, in view of the fact that a minute amount of sol. Al is unavoidably present in steel as an impurity, from the standpoint of economic efficiency, the content of sol. Al is preferably at least 0.0001%. As stated below, from the standpoint of ensuring a sol. Ti content of at least 0.004%, the content of sol. Al is preferably at least 0.0005%. As also stated below, Al itself can be used for preliminary deoxidation and temperature adjustment during the process of preparing molten steel. Therefore, from this standpoint, the sol. Al content is preferably at least 0.0002%. It is particularly preferable for it to be at least 0.0005%.

(h) Ti: 0.005-0.05%

Ti is an important element which performs deoxidation of steel and which forms a suitable amount of $TiO_x$ inclusions which are necessary for obtaining a steel sheet having a high r value. In addition, due to precipitation of a part of Ti as TiN, it suppresses the occurrence of stretcher strains and an increase in yield stress caused by N and makes it more difficult for surface strains to develop at the time of working. For this purpose, the Ti content is at least 0.005%.

However, if Ti is present in excess of 0.05%, the amount of precipitation of Ti(C,N) increases to such an extent that elongation deteriorates causing surface strains and cracks to develop more readily at the time of working. In addition, when hot-dip galvanizing is carried out on the surface of a cold-rolled steel sheet, it becomes easy for a streaky pattern to appear on the plated surface. Therefore, the Ti content is at most 0.05%. Since Ti is a relatively expensive added element, the Ti content is preferably at most 0.025% from the standpoint of reducing the added amount of Ti and reducing manufacturing costs while realizing an increase in workability and suppressing surface defects in hot-dip galvanized plating.

(i) Nb: 0.020-0.200%

Like Ti, Nb combines with C to form NbC precipitates, thereby improving mechanical properties. Nb is also essential for realizing an increase in $r_{45}$, which is an object of the present invention. Nb contributes to an increase in $r_{45}$ by forming complex precipitates in the form of Nb(C,N) on $TiO_x$. For this purpose, the Nb content is at least 0.020%. From the standpoint of guaranteeing formability and strength, the Nb content is preferably at least 0.040%. More preferably, it is at least 0.050%. If the Nb content is less than 0.020%, the amount of precipitation of NbC is insufficient to fix dissolved C adequately. As a result, surface defects such as stretcher strains may develop easily, or it may become difficult to stably guarantee tensile strength. On the other hand, if the Nb content exceeds 0.200%, the amount of Nb becomes excessive compared to C, and the yield strength increases with elongation decreasing, thereby causing wrinkles to easily develop at the time of working. Accordingly, the Nb content is at most 0.200%.

(j) Nb/Ti≥2

In the present invention, combined addition of Ti and Nb is essential. In order to further increase $r_{45}$ which is desired in the present invention, there is a suitable balance between the contents of Nb and Ti, and the ratio (Nb/Ti) of the contents of Nb and Ti should be at least 2. If the ratio Nb/Ti is less than 2, it becomes difficult to form Nb(C,N) complex precipitates on $TiO_x$, and the grain refining effect on hot-rolled steel sheet decreases. As a result, it becomes difficult to increase the value of $r_{45}$. There is no particular upper limit on Nb/Ti, but if it is excessively high, the recrystallization temperature increases, and it becomes necessary to perform annealing at a high temperature. Therefore, the ratio Nb/Ti is preferably at most 20.

The chemical composition of a steel according to the present invention may further satisfy the following conditions.

(k) sol. Ti: at least 0.004%

Particularly from the standpoint of further increasing $r_{45}$ and the mean r value, the formation of $TiO_x$ inclusions can be promoted and a high r value is obtained when sol. Ti is made at least 0.004%. There is no particular upper limit on sol. Ti, but it is preferably at most 0.04%. When carrying out hot-dip galvanizing of the surface of a cold-rolled steel sheet, sol. Ti sometimes causes formation of a streaky pattern in the plated surface, so the sol. Ti content is preferably at most 0.02%.

(l) B: at most 0.0020%

B has the effect of preventing embrittlement caused by secondary working, so a portion of Fe may be replaced by B. If the B content exceeds 0.0020%, the r value markedly decreases. Therefore, the content of B is at most 0.0020%, and preferably it is at most 0.0010%. When B is contained in order to prevent secondary working embrittlement, the B content is preferably at least 0.0001%. More preferably it is at least 0.0003%.

(m) One or more elements selected from Cr: at most 1%, Mo: at most 1%, V: at most 1%, W: at most 1%, Cu: at most 1% and Ni: at most 1%

A portion of Fe may be replaced by these elements in order to ensure strength of steel. If the content of any of these elements exceeds 1%, the effect of increasing strength saturates and addition of the elements becomes uneconomical. Therefore, the content of each element is at most 1%. Preferably the content of each element is at most 0.5%.

When added for securement of strength, the content of each element is preferably at most 0.01%.

(2) Inclusions

The average number density of $TiO_x$ having a major axis with a length of at least 1 μm in a cross section of the thickness of a steel sheet product is preferably at least 30/mm$^2$. More preferably, it is at least 60/mm$^2$. There is no particular restriction on the shape of inclusions, but spheres or rounded cubic shapes are particularly preferred. Those inclusions having a major axis with a length of at least 1 μm in the observed cross section are of interest and counted. These inclusions are primarily composed of Ti oxides having a composition of at least one of $TiO_2$, $Ti_2O_3$, and $Ti_3O_5$, and may form a complex with a carbonitride of Ti or Nb or with an Mn oxide. A steel sheet having a high r value is obtained when there is a large amount of such complexed inclusions. When the average number density of TiO inclusions is less than 30/mm$^2$, the density of the sites where carbonitrides of Nb and Ti are precipitated to form complex inclusions is inadequate, and the effect of imparting a high r value becomes small. There is no particular need to set an upper limit on the density of these inclusions from the standpoint of obtaining a high r value, but from the standpoint of the surface appearance of a cold-rolled steel sheet, the upper limit is preferably at most 1000/mm$^2$ and more preferably at most 500/mm$^2$.

Of the inclusions which are precipitated when the above-described steel composition is selected, NbO inclusions and $SiO_2$ inclusions which are both in elongated forms and worsen formability are preferably each less than 1.0% of the total number of inclusions from the standpoint of increasing the r value. In order to guarantee the sufficient number of $TiO_x$ inclusions, the total O content of steel is preferably at least 0.0020 mass % and more preferably at least 0.0030 mass %.

(2) Other Features of Inclusions

In addition to the above-described chemical composition, a steel sheet according to the present invention may have the following features with respect to inclusions having a major axis with a length of at least 1 μm which are observed in a vertical cross section parallel to the rolling direction of a steel sheet (referred to below as a vertical cross section in the rolling direction).

a) The average number density $N_{Ti}$ of first type inclusions containing at least 50 mass % of Ti oxides calculated as $TiO_2$ is at least 30/mm$^2$ (see Equation (1)).

$$N_{Ti} \geq 30/mm^2 \quad (1)$$

The term "average number density" herein used means the average number of the particular inclusions observed in a cross section per mm$^2$. It has the units of number of inclusions/mm$^2$.

b) The average number density $N_{Al}$ of second type inclusions containing at least 50 mass % of Al oxides calculated as $Al_2O_3$ which are in the above-described cross section and $N_{Ti}$ satisfy the following Equation (2).

$$N_{Ti}/(N_{Ti}+N_{Al}) \geq 0.80 \quad (2)$$

c) The average number density $N_{Total}$ of all oxide inclusions observed in the above cross section and $N_{Ti}$ satisfy the following Equation (3).

$$N_{Ti}/N_{Total} \geq 0.65 \quad (3)$$

In the following explanation, α indicates the inclusion ratio $N_{Ti}/(N_{Ti}+N_{Al})$ in Equation (2), and β indicates the inclusion ratio $N_{Ti}/N_{Total}$ in Equation (3).

In a steel sheet according to the present invention, inclusions comprising predominantly $TiO_x$ which is formed by deoxidation with Ti, are necessary in order to exhibit a high r value.

As stated earlier, $TiO_x$ is the generic indication of Ti oxides in steel. When determining their concentration, $TiO_x$ is calculated as $TiO_2$.

Inclusions containing $TiO_x$ encompass not only $TiO_x$ itself but also those containing carbides and/or nitrides of Ti and/or Nb. Accordingly, the term "inclusions comprising predominantly $TiO_x$" refers to inclusions containing at least 50 mass % of $TiO_x$ calculated as $TiO_2$.

(3) Average Number Density of Inclusions Comprising Predominantly $TiO_x$

In a steel sheet according to the present invention, it is necessary that the first type inclusions (of those inclusions comprising predominantly $TiO_x$ which are observed in a vertical cross section in the rolling direction, those having a length elongated in the rolling direction of at least 1 μm) have an average number density of at least 30/mm$^2$ and preferably at least 60/mm$^2$. If the average number density of these inclusions is less than 30/mm$^2$, there are not enough sites for complex precipitation of carbonitrides of Nb and Ti, and the effect provided by the inclusions of imparting a high r value in a steel sheet decreases. There is no particular need to set an upper limit from the standpoint of increasing the r value, but from the standpoint of the surface appearance of a cold-rolled steel sheet, the number density is preferably at most 1000/mm$^2$. More preferably it is at most 500/mm$^2$.

(4) Experimental Evaluation of the Relationship Between the Amount of Inclusions in Steel and the r Value When manufacturing a steel according to the present invention in a mass production process, the steel may contain inclusions other than $TiO_x$ due to various factors. Specifically, in a mass production process, Al and $Al_2O_3$ are contained in refractory materials used for holding molten steel, in refractory materials used for isolation from the atmosphere, and in auxiliary raw materials. In addition, when partially removing oxygen which is contained in steel in an amount of approximately 0.03-0.08% for decarburization, Al is often added on account of its low cost and quick action. In addition, Al is sometimes added with the object of increasing the temperature of molten steel by heat of oxidation. Thus, it is difficult to avoid the presence of Al in molten steel in a manufacturing process for mass production. As a result, inclusions comprising predominantly $Al_2O_3$ are unavoidably present in steel. The term "inclusions comprising predominantly $Al_2O_3$" include those inclusions containing at least 50 mass % of $Al_2O_3$ with the remainder being $TiO_x$, MnO, MgO, and the like.

There are no particular restrictions on methods of measuring the composition and amount of inclusions. The following methods are examples of possible methods.

The inclusions which are the object of measurement in the present invention are produced by a deoxidation reaction, and they are distinguished from macroinclusions incorporated by exfoliation of refractories or the like. Many of the observed inclusions have a size of only several micrometers to several tens of micrometers even in the diameter of equivalent circles. The inclusions are of discrete or isolated particle shapes in the form of lumps or rounded lumps, and the distribution and shape characteristics of inclusions in castings remains after the castings have been subjected to hot rolling and cold rolling. Namely, contrary to the above-described macroinclusions or cluster inclusions which are often observed at the time of Al deoxidation, almost none are crushed into fragments during hot rolling or cold rolling such that the resulting discrete fragments are arranged in a row in the longitudinal direction of rolling, and almost none undergo plastic deformation in a hot rolling temperature range so as to become inclusions elongated in the same direction. There is almost no essential difference in the evaluation of lumpy inclusions which are not readily affected by plastic deformation of steel during hot rolling and cold rolling whether they are evaluated as test materials taken from molten steel at the time of casting, as castings, as hot-rolled steel sheets, or as cold-rolled steel sheets.

From the standpoint of ease of handling of samples, inclusions are preferably measured in hot-rolled steel sheets or cold-rolled steel sheets, while from the standpoint of ease of observation, inclusions are preferably measured in a hot-rolled steel sheet.

A method of measuring inclusions is as follows. A sample with a length of approximately 10-20 mm is taken from approximately the center of the width of a steel strip which has been hot-rolled to a thickness of approximately 4.0 mm so that a cross section in the rolling direction which is perpendicular with respect to the sheet can be observed. The observed surface area is arbitrary, but taking into consideration measurement errors, the area is preferably such that the number of measurable inclusions which are the object of observation is from several tens to one hundred and several tens or above. For this purpose, an area of around several $mm^2$ is necessary. When observing inclusions in a cold-rolled steel sheet, in the same manner, the length of an observed area is made approximately 10-20 mm so that a cross section in the rolling direction which is perpendicular with respect to the sheet and which is taken from the center of the width of a steel strip can be observed. When several $mm^2$ of observed area are necessary as described above, a sample can be taken at a plurality of positions.

A vertical cross section in the rolling direction of a test piece which is obtained in this manner is used as an observed surface, and inclusions which are exposed on this surface are observed. The shape of inclusions is evaluated using a scanning electron microscope (SEM), and inclusions which are only slightly elongated in the rolling direction and which have a length of at least 1 μm are selected as objects to be measured. Using an energy dispersive x-ray microanalyzer (EDS) attached to the SEM, the number of inclusions is counted while distinguishing the first type inclusions from the second type inclusions. The total number of oxide-type inclusions is also counted using the SEM and EDS.

In order to clarify the relationship between the amount of inclusions in steel including inclusions comprising predominantly $Al_2O_3$ and the r value of a cold-rolled steel sheet, the following experiment was carried out using the above-described measurement method. As a result, it was found that when the relationships given by above-described Equations (2) and (3) exist between the first type inclusions and the above-described second type inclusions (Al oxide inclusions comprising predominantly $Al_2O_3$ and having the same shape characteristics as the first type inclusions i.e., which are elongated to a length of at least 1 μm in the rolling direction when observed in a vertical cross section in the rolling direction) or all oxide-type inclusions, a steel sheet having an excellent r value is obtained, as described below in detail.

First, a steel containing C: 0.001-0.002%, Si: 0.005-0.03%, Mn: 0.40-0.48%, P: 0.045-0.055%, S: 0.004-0.006%, sol. Al: 0.0005-0.0014%, Ti: 0.010-0.015%, and Nb: 0.040-0.060% was melted in a 30-kg induction heating furnace having an adjustable atmosphere. The ratio (Nb/Ti) at this time was in the range of 3.0-4.5.

At this time, Al was added in a state of a high oxygen concentration in such an amount that $Al_2O_3$-type inclusions were suspended and the sol. Al concentration was a low value. Ti was then added to obtain a desired Ti concentration, and then casting was immediately performed. In this manner, a base steel material having the above-described composition and including $TiO_x$-type inclusions and $Al_2O_3$-type inclusions was prepared.

This base steel material was heated to 1250° C. and then subjected to forging with a finishing temperature of 920° C. which corresponded to hot rolling to prepare a hot-rolled sheet with a thickness of 4.0 mm. The sheet was then subjected to cold rolling and annealing to obtain a cold-rolled steel sheet with a thickness of 0.7 mm. A JIS No. 5 test piece was taken from the cold-rolled steel sheet in a direction at 45° with respect to the rolling direction, and it was used to carry out a tensile test and determine the r value. As described above, the r value in a direction at 45° with respect to the rolling direction is also referred to as $r_{45}$ (sometimes referred to as $R_{45}$ in the drawings).

Samples were prepared in the following manner in order to count the number of inclusions. The central portion in the width direction of a steel sheet with a thickness of 0.7 mm was cut so as to obtain a vertical cross section in the rolling direction, and then the sheet was cut so as to obtain a length of approximately 10 mm in the rolling direction. In this manner, a test piece having a vertical cross section in the rolling direction with an area of approximately 7.0 $mm^2$ was obtained.

The vertical cross section in the rolling direction of the test piece (sample) which was obtained in this manner was used as an observed surface, and the number of inclusions which were exposed in this surface were counted while distinguishing between first type inclusions and second type inclusions using an SEM and an EDS attached to the SEM. The total number of oxide-type inclusions was also counted using the SEM and EDS.

The average number densities of first type inclusions, second type inclusions, and all oxide-type inclusions were determined based on the results of measurement of the number of inclusions that was carried out in this manner. From these values, the inclusion ratios α and β were determined. The relationship between the thus obtained inclusion ratios and the $r_{45}$ value of separately prepared JIS No. 5 test pieces was evaluated. The number of $TiO_x$ inclusions in each of the steel sheets used in the above-described evaluation was at least 30/$mm^2$.

(5) Inclusion Ratio α

Figure 2:
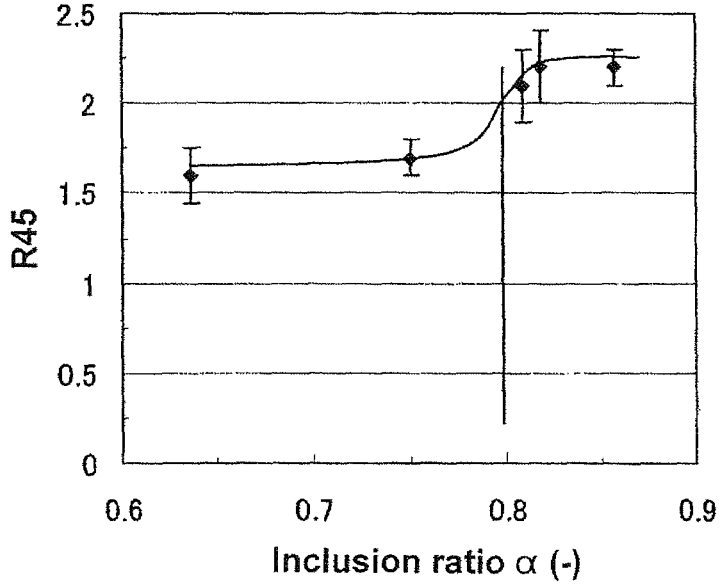
FIG. 2 is a graph showing the relationship between the inclusion ratio $\alpha$ and the value of $r_{45}$.

The effect of the inclusion ratio α on the value of $r_{45}$ is illustrated in FIG. 2. As shown in this figure, the value of $r_{45}$ is affected by the inclusion ratio α, and when α is at least 0.80, $r_{45}$ exceeds 2.0. Namely, $TiO_x$-type inclusions have a greater effect on increasing $r_{45}$ than do $Al_2O_3$-type inclusions, and extremely good drawability can be obtained by making the inclusion ratio α at least 80%. Extremely good drawability can be stably obtained if the inclusion ratio α is at least 82%.

(6) Inclusion Ratio β

Figure 3:
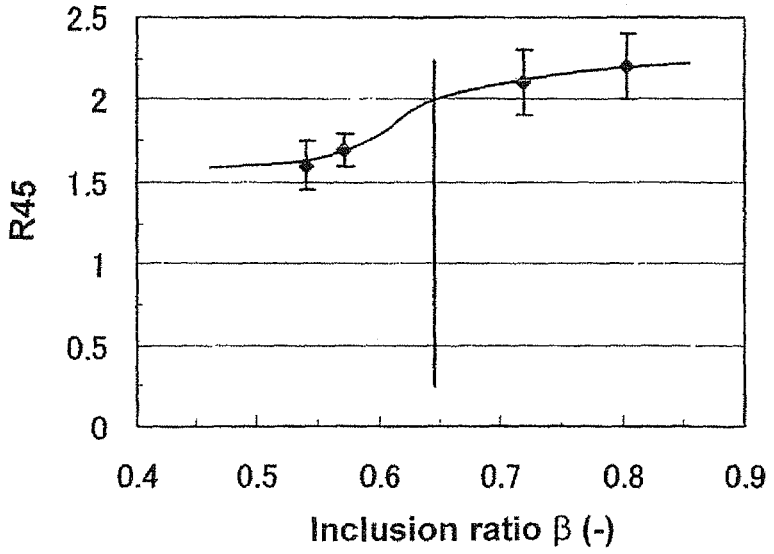
FIG. 3 is a graph showing the relationship between the inclusion ratio $\beta$ and the value of $r_{45}$.

The effect of the inclusion ratio β on the value of $r_{45}$ is illustrated in FIG. 3. As shown in this figure, $r_{45}$ is influenced by this inclusion ratio, and if β is at least 0.65, $r_{45}$ exceeds 2.0. If the inclusion ratio β is at least 0.8, a value of $r_{45}$ exceeding 2.0 can be stably obtained.

2. Manufacturing Process

A preferred process for manufacturing a cold-rolled steel sheet and a hot-dip galvanized steel sheet according to the present invention will be explained below.

(1) Steelmaking Step

The processing aspects at the stage of steel making will be explained. A manufacturing process according to the present invention is characterized by performing deoxidation primarily with Ti while decreasing the amount of Al.

In a process according to the present invention, prior to deoxidation of molten steel which is carried out before continuous casting, molten steel is preferably decarburized under a reduced pressure. In a preferred example of a manufacturing process for mass production, molten steel undergoes refining using a usual oxygen-blowing converter, and then decarburization is carried out under a reduced pressure in a refining process outside the converter. Such operation makes it possible for molten steel to effectively undergo decarburization at a reduced pressure.

Following the above-described decarburization, Ti or a Ti alloy (referred below simply as Ti) is added to the resulting undeoxidized molten steel, leading to the formation of $TiO_x$ using the dissolved oxygen in the molten steel. In order to suppress the amount of Ti which is consumed by deoxidation, prior to addition of Ti, it is possible to add Mn or an Mn alloy (referred to below simply as Mn), Si or an Si alloy (referred to below simply as Si), and/or a small amount of Al or an Al alloy (referred to below simply as Al) in order to deoxidize the molten steel to a certain extent. From the standpoint of suppressing the Al content, it is preferable not to add Al and to instead add Mn or Si to the undeoxidized molten steel.

As a result of the above-described steelmaking procedure, it is easy to produce inclusions having a spherical or rounded lumpy shape having an average number density of $TiO_x$ (which are an oxide-type inclusions of Ti) having a length of at least 1 μm of at least 30/mm$^2$.

During continuous casting, inclusions tend to accumulate in the surface layer of the resulting slab. As a result, it sometimes becomes easy for surface defects to develop in the thin sheet which is the final product. Therefore, at the time of continuous casting, it is desirable to make molten steel flow within the mold by an external means such as electromagnetic stirring. By making molten steel flow in a mold, capture of inclusions by a solidified shell during solidification of molten steel can be suppressed, and inclusion defects in the surface layer of the resulting slab can be suppressed.

(2) Hot Rolling Step a) Temperature at the Start of Hot Rolling: 1100-1270° C.

After an ingot or slab having the steel composition described above in (1) is heated to 1100-1270° C., hot rolling is carried out. The ingot or slab may be one which was at a temperature of lower than 1100° C. but is reheated to 1100-1270° C. prior to hot rolling. Alternatively, when using a continuously cast slab, the slab may be subjected to hot rolling after it has cooled to 1100-1270° C. without its temperature being decreased to lower than 1100° C. after continuous casting. When using a slab, the slab obtained by slabing from an ingot may be subjected to hot rolling after it has cooled to 1100-1270° C. without its temperature being decreased to lower than 1100° C. after slabing.

When the temperature of an ingot or slab which is subjected to hot rolling is less than 1100° C., resistance to deformation so increases that it sometimes becomes difficult to perform hot rolling, while when the temperature exceeds 1270° C., an excessive amount of scale may form and remain after cold rolling and worsen the surface appearance.

Therefore, the temperature of an ingot or slab which is subjected to hot rolling is preferably made 1100-1270° C.

b) Temperature at the Completion of Hot Rolling: $Ar_3$ Point—1000° C.

If the temperature at the completion of hot rolling is less than the $Ar_3$ point, the surface layer of the steel sheet becomes ferritic and the hot-rolled structure easily coarsens. As a result, the r value of the steel sheet decreases and cracks may form at the time of working, and in the case of a hot-dip galvanized steel sheet, a streaky pattern may form in the plating surface. On the other hand, if the temperature at the completion of hot rolling exceeds 1000° C., the surface appearance readily deteriorates due to scale. Accordingly, the temperature at the completion of hot rolling is made the $Ar_3$ point to 1000° C. A preferred temperature range is the $Ar_3$ point to 950° C. In order to adjust the temperature at the completion of hot rolling in the above-described temperature range, the sheet bar before completion of rolling may be heated by a heating apparatus. At this time, heating is desirably carried out such that the rear end of the steel strip is at a higher temperature than its front end in order to decrease the temperature variation over the entire length of the steel strip and increase the uniformity of properties in a coil.

c) Coiling Temperature: 400-700° C.

If the coiling temperature is less than 400° C., the formation of carbonitrides and particularly NbC after coiling becomes inadequate, and the effect of NbC may not be achieved adequately. In this case, the r value decreases and it becomes easy for cracks to develop at the time of working. On the other hand, if the coiling temperature exceeds 700° C., there is excessive formation of scale, leading to an increased possibility of the surface appearance being deteriorated and a decrease in strength. A preferred coiling temperature is 400-650° C.

(3) Pickling Step, Cold Rolling Step, Annealing Step, and Plating Step

The hot-rolled steel sheet obtained by hot rolling is subjected to descaling by pickling, it is cold-rolled, and then it undergoes recrystallization annealing. In the case of a galvannealed steel sheet, the sheet further undergoes hot-dip galvanizing and alloying heat treatment.

Pickling may be carried out in a conventional manner. Cold rolling is carried out with a reduction of at least 50%, and it is followed by recrystallization annealing so as to develop a recrystallization texture and thereby achieve a high r value which is favorable for drawability. Recrystallization annealing is carried out by soaking at a temperature which is at least the recrystallization temperature and less than the $Ac_3$ point. If the soaking temperature exceeds the $Ac_3$ point, a recrystallization texture favorable for drawability is destroyed by transformation and the r value decreases.

When manufacturing a galvannealed steel sheet, it is preferable to continuously carry out an annealing step, a hot-dip galvanizing step, and an alloying heat treatment step using a continuous hot-dip galvanizing line from the standpoint of productivity. Galvannealing process may be carried out by a conventional technique.

A cold-rolled steel sheet according to the present invention can be used as a substrate sheet for a hot-dip metal plated steel sheet, an electroplated steel sheet, a tinned steel sheet, a paint-coated steel sheet, or other surface treated steel sheet obtained by subsequent surface treatment. Examples of hot-dip metal plating are hot-dip galvanizing, hot-dip Al plating, and hot-dip Al alloy plating. Particularly in the case of electroplating, if there is an uneven distribution of Ti-based precipitates, the texture of the base steel material after annealing changes so as to make the orientation of plating uniform, whereby streaky surface irregularities can be observed on the plated surface. In order to suppress this problem, a cold-rolled steel sheet according to the present invention is preferably used as a substrate sheet for plating. The above-described types of surface treatment may be carried out in a conventional manner. For example, when manufacturing an electroplated steel sheet, electroplating may be carried out after recrystallization annealing using an electroplating line.

(4) Vacuum Refining Step a) Investigation Premised on a Mass Production Process

Next, the results of an investigation of a process of manufacturing the above-described steel which is premised on a mass production process will be described.

As described above, an ultralow carbon steel in a large scale steelmaking plant is manufactured by initially carrying out rough decarburization to remove carbon in a steelmaking furnace such as a converter to form low carbon molten steel having a carbon concentration of 0.04 mass % to 0.07 mass %. It is then discharged into a vessel such as a ladle in an undeoxidized state. The discharged molten steel is transferred into a vacuum degassing apparatus such as an RH apparatus and undergoes vacuum decarburization to form an ultralow carbon molten steel having a carbon concentration of at most 0.025 mass %. In the decarburization reaction at this time, it is necessary for the molten steel to contain oxygen which reacts with carbon. The oxygen concentration of the molten steel is from about 0.03 mass % to around 0.08 mass %.

A large scale manufacturing process unavoidably produces $Al_2O_3$-type inclusions at this time. The first reason for the formation of $Al_2O_3$-type inclusions is the presence of Al in the steel and $Al_2O_3$ sources in the surroundings. The Al and $Al_2O_3$ come from metallic Al contained in alloy iron such as FeSi, $Al_2O_3$ contained in ladle slag, $Al_2O_3$ which adheres to the inner surface of the ladle during previous molten steel refining operation, and $Al_2O_3$ which adheres to the interior of the vacuum degassing apparatus during previous molten steel refining operation. The second reason for the formation of $Al_2O_3$-type inclusions is the $Al_2O_3$ which is formed by heating of molten steel for the purpose of compensating for the temperature decrease of molten steel which occurs during vacuum decarburization. This heating unavoidably produces a large amount of $Al_2O_3$-type inclusions since molten steel is heated by an oxidation reaction between metals such as Al and oxygen gas. The third reason for the formation of $Al_2O_3$-type inclusions is the addition of Al in order to rapidly remove oxygen remaining in molten steel after decarburization. As a result, suspension of a large amount of $Al_2O_3$-type inclusions is unavoidable.

Namely, assuming large scale or mass production, suspension of $Al_2O_3$-type inclusions in molten steel is unavoidable due to the presence of various sources of $Al_2O_3$ inclusions, and it is necessary to conceive of a means for avoiding this situation prior to carrying out deoxidation with Ti by addition of Ti.

b) Dependency of the Average $Al_2O_3$ Concentration in Inclusions on the Dissolved Oxygen Concentration Before addition of Ti, molten steel containing a high concentration of dissolved oxygen was maintained at a steel refining temperature of around 1873 K in the presence of $Al_2O_3$-type oxides for a length of time corresponding to a steel refining step. A sample of the molten steel which was held at this temperature was collected using a bomb, and the inclusions contained therein were investigated with an SEM and EDS. It was confirmed that a $(Mn,Fe)AlO_4$ phase and/or a $MnO—SiO_2—Al_2O_3$ phase were observed, although their contents varied with the Mn concentration and Si concentration in the molten steel.

To the molten steel in a state in which this $(Mn,Fe)AlO_4$ phase and/or $MnO—SiO_2—Al_2O_3$ phase were suspended, Ti was added, and a molten steel sample was collected to investigate inclusions contained in the sample. Ti oxide inclusions were observed, and it was ascertained that the added Ti changed to $TiO_x$.

In contrast, when the same molten steel as above in a state in which the above-described $(Mn,Fe)AlO_4$ phase and/or $MnO—SiO_2—Al_2O_3$ phase was suspended was processed by initially adding Al to form $Al_2O_3$ suspended therein and then adding Ti, a molten steel sample was taken, and inclusions contained in the sample were investigated, it was found that many inclusions are $Al_2O_3$-type inclusions containing at least 40 mass % of $Al_2O_3$ in which $TiO_x$ or MgO is contained.

Based on the results of these basic investigations, the relationship between molten steel composition, the oxygen activity, and the composition of nonmetallic inclusions in circulating treatment of the molten steel were investigated using undeoxidized molten steel or Al deoxidized molten steel and a RH degassing apparatus for treating them. The molten steel which was used contained 0.01-0.04% of Si, 1.10-1.40% of Mn, and 0.0005-0.005% of sol. Al. An oxygen sensor which operated on the principle of an oxygen concentration cell using a solid electrolyte was used for measurement of oxygen activity. Molten steel was collected in an iron bomb sampler, and a sample cross section was polished to a mirror finish. The average composition of nonmetallic inclusions observed on the polished cross section was investigated with an SEM and EDS. The results are shown in FIG. 4.

Figure 4:
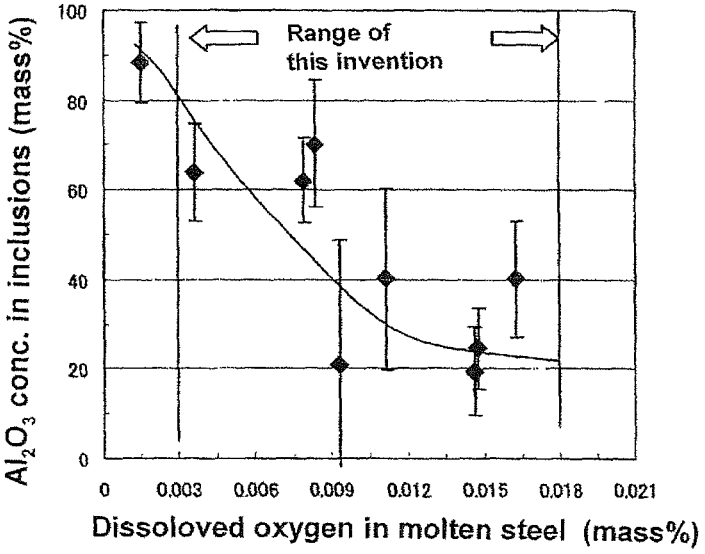
FIG. 4 is a graph showing the relationship between the concentration of dissolved oxygen in molten steel and the concentration of $Al_2O_3$ in inclusions.
Figure 5:
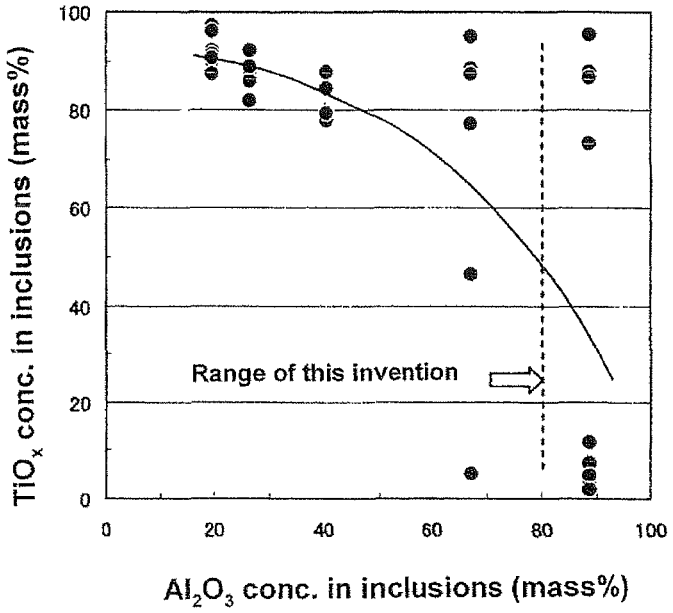
FIG. 5 is a graph showing the relationship between the concentration of $Al_2O_3$ in inclusions before addition of Ti and the concentration of $TiO_x$ in inclusions after addition of Ti.

As shown in FIG. 4, if the concentration of dissolved oxygen as converted to an oxygen concentration is at least 0.003%, the average $Al_2O_3$ concentration of inclusions becomes at most 80 mass %, and the composition of $Al_2O_3$-containing inclusions changes to $MnO—Al_2O_3$-type inclusions and $SiO_2—MnO—Al_2O_3$-type inclusions. The converted oxygen concentration of dissolved oxygen is preferably at least 0.0085% because the average $Al_2O_3$ concentration in inclusions becomes at most 60 mass % and $TiO_x$-type inclusions can be formed with certainty. The upper limit on the converted oxygen concentration of dissolved oxygen in molten steel is at most 0.018%, since the added amount of Ti required for deoxidation increases and cleanliness after deoxidation worsens.

c) Relationship Between the Average $Al_2O_3$ Concentration in Inclusions and the $TiO_x$ Concentration in Inclusions after the Addition of Ti The relationship between the average $Al_2O_3$ concentration in inclusions before addition of Ti and the concentration of $TiO_x$ in inclusions after addition of Ti is shown in FIG. 5. As shown in the figure, if the average $Al_2O_3$ concentration in inclusions before addition of Ti is at most 80 mass %, the percent of $TiO_x$-type inclusions which are formed increases. The average $Al_2O_3$ concentration is preferably 60 mass % or less, because at this level, it is no longer possible to observe inclusions having a high concentration of remaining $Al_2O_3$, and it is possible to form $TiO_x$-type inclusions with greater certainty.

d) Relationship Between the Average $TiO_x$ Concentration in Inclusions and the Sol. Ti Concentration The concentration of acid-soluble Ti, namely, the sol. Ti concentration in steel will be explained. The Ti concentration which is determined by usual Ti analysis (referred to below as the total Ti concentration) includes Ti contained in steel as oxides. In general, in the case of Al deoxidized steel, the amount of Ti which is contained as oxides is negligibly small, so the total Ti concentration is nearly equal to the sol. Ti concentration. However, a steel according to the present invention is basically a Ti deoxidized steel, in which a large amount of Ti oxides are present. Therefore, it is important to specify the sol. Ti concentration which is related to the concentration of dissolved Ti other than oxides. Namely, in order to make the average $TiO_x$ concentration in inclusions at least 80 mass % with certainty, it is necessary for sol. Ti concentration to be at least 0.004%. More preferably, sol. Ti is contained in an amount of at least 0.006%.

Example 1

The following examples are provided to explain the present invention more specifically, but the present invention is not limited by these examples in any manner.

In the examples, an explanation is given of an example of a galvannealed steel sheet. The same process can be employed to obtain a cold-rolled steel sheet by omitting a hot-dip plating step.

1. Testing Method

In order to ascertain the effects of the present invention, continuous casting was carried out using molten steels manufactured under various test conditions, and the effects were evaluated on a product in the form of a thin sheet.

Steel sheets of Sample Nos. 1-35 having the chemical compositions shown in Table 1 and Table 2 were prepared as described below. In the chemical compositions shown in Table 1 and Table 2, the content of each element is given in mass %, with the remainder being iron and impurities.

TABLE 1

| No | C | Si | Mn | P | S | Ti | Nb | N | B | sol. Al | Other elements | Nb/Ti | HR* initial temp. (° C.) | HR* finish temp. (° C.) | Coiling temp. (° C.) |
|---|---|---|---|---|---|---|---|---|---|---|---|---|---|---|---|
| 1 | 0.0032 | 0.04 | 1.35 | 0.064 | 0.006 | 0.015 | 0.061 | 0.0020 | 0.0004 | 0.0032 | | 4.1 | 1180 | 900 | 650 |
| 2 | 0.0072 | 0.04 | 0.31 | 0.020 | 0.006 | 0.011 | 0.045 | 0.0020 | 0.0004 | 0.0042 | | 4.1 | 1150 | 850 | 630 |
| 3 | 0.0025 | 0.06 | 1.00 | 0.049 | 0.007 | 0.016 | 0.040 | 0.0025 | 0.0005 | 0.0035 | | 2.5 | 1200 | 950 | 550 |
| 4 | 0.0006 | 0.05 | 2.00 | 0.048 | 0.007 | 0.007 | 0.099 | 0.0024 | 0.0008 | 0.0042 | | 14.1 | 1250 | 940 | 610 |
| 5 | 0.0082 | 0.05 | 0.80 | 0.049 | 0.007 | 0.034 | 0.077 | 0.0024 | 0.0004 | 0.0049 | | 2.3 | 1270 | 930 | 530 |
| 6 | 0.0016 | 0.05 | 0.81 | 0.082 | 0.007 | 0.040 | 0.180 | 0.0024 | 0.0004 | 0.0028 | | 4.5 | 1170 | 920 | 590 |
| 7 | 0.0011 | 0.06 | 0.99 | 0.050 | 0.016 | 0.006 | 0.023 | 0.0021 | 0.0003 | 0.0005 | | 3.8 | 1190 | 910 | 570 |
| 8 | 0.0134 | 0.06 | 2.40 | 0.050 | 0.006 | 0.050 | 0.120 | 0.0020 | 0.0003 | 0.0023 | | 2.4 | 1260 | 910 | 400 |
| 9 | 0.0032 | 0.09 | 1.39 | 0.043 | 0.006 | 0.011 | 0.085 | 0.0023 | 0.0002 | 0.0024 | | 7.7 | 1220 | 900 | 420 |
| 10 | 0.0021 | 0.09 | 1.01 | 0.053 | 0.014 | 0.022 | 0.085 | 0.0022 | 0.0003 | 0.0035 | | 3.9 | 1210 | 970 | 440 |
| 11 | 0.0038 | 0.07 | 1.01 | 0.063 | 0.006 | 0.020 | 0.102 | 0.0057 | 0.0003 | 0.0011 | | 5.1 | 1180 | 890 | 470 |
| 12 | 0.0017 | 0.04 | 1.99 | 0.049 | 0.006 | 0.043 | 0.195 | 0.0020 | 0.0020 | 0.0003 | | 4.5 | 1180 | 870 | 490 |
| 13 | 0.0088 | 0.06 | 1.20 | 0.039 | 0.005 | 0.008 | 0.095 | 0.0021 | 0.0004 | 0.0040 | | 11.9 | 1200 | 880 | 510 |
| 14 | 0.0210 | 0.05 | 0.51 | 0.048 | 0.007 | 0.009 | 0.064 | 0.0024 | 0.0015 | 0.0005 | | 7.1 | 1220 | 860 | 530 |
| 15 | 0.0016 | 0.08 | 1.21 | 0.035 | 0.007 | 0.030 | 0.084 | 0.0024 | — | 0.0009 | | 2.1 | 1210 | 940 | 550 |
| 16 | 0.0057 | 0.09 | 0.84 | 0.048 | 0.006 | 0.040 | 0.086 | 0.0032 | 0.0005 | 0.0007 | Cr: 0.1<br>Ni: 0.05 | 2.2 | 1200 | 900 | 550 |
| 17 | 0.0021 | 0.09 | 0.71 | 0.053 | 0.006 | 0.022 | 0.085 | 0.0040 | 0.0003 | 0.0015 | Mo: 0.2<br>Cr: 0.1 | 3.9 | 1210 | 900 | 440 |
| 18 | 0.0005 | 0.04 | 0.69 | 0.049 | 0.006 | 0.032 | 0.097 | 0.0020 | 0.0004 | 0.0005 | Cr: 0.18<br>V: 0.04<br>W: 0.03 | 3.0 | 1100 | 850 | 630 |

| No | Annealing temp. (° C.) | Direction (°) | YS (MPa) | TS (MPa) | EL (%) | YPE (%) | r value | $r_m$ | sol. Ti (%) |
|---|---|---|---|---|---|---|---|---|---|
| 1 | 835 | 0 | | | | | 1.77 | 2.03 | 0.0044 |
| | | 45 | | | | | 2.04 | | |
| | | 90 | 236 | 402 | 37.2 | 0.0 | 2.27 | | |
| 2 | 840 | 0 | | | | | 1.61 | 1.97 | 0.0061 |
| | | 45 | | | | | 1.99 | | |
| | | 90 | 234 | 398 | 40.3 | 0.0 | 2.27 | | |
| 3 | 840 | 0 | | | | | 1.62 | 2.08 | 0.0058 |
| | | 45 | | | | | 2.30 | | |
| | | 90 | 199 | 362 | 41.2 | 0.0 | 2.10 | | |
| 4 | 800 | 0 | | | | | 1.80 | 2.00 | 0.0041 |
| | | 45 | | | | | 2.10 | | |
| | | 90 | 221 | 390 | 37.3 | 0.0 | 1.99 | | |
| 5 | 820 | 0 | | | | | 1.78 | 1.95 | 0.0063 |
| | | 45 | | | | | 2.01 | | |
| | | 90 | 230 | 432 | 36.8 | 0.0 | 2.00 | | |
| 6 | 840 | 0 | | | | | 1.84 | 2.11 | 0.0089 |
| | | 45 | | | | | 2.29 | | |
| | | 90 | 210 | 378 | 38.8 | 0.0 | 2.22 | | |
| 7 | 835 | 0 | | | | | 1.55 | 1.68 | 0.0057 |
| | | 45 | | | | | 1.75 | | |
| | | 90 | 226 | 359 | 36.8 | 0.0 | 1.67 | | |
| 8 | 840 | 0 | | | | | 1.43 | 1.88 | 0.0120 |
| | | 45 | | | | | 2.02 | | |
| | | 90 | 278 | 510 | 36.2 | 0.0 | 2.05 | | |
| 9 | 850 | 0 | | | | | 1.43 | 1.99 | 0.0048 |
| | | 45 | | | | | 2.18 | | |
| | | 90 | 229 | 388 | 39.5 | 0.0 | 2.15 | | |

TABLE 1-continued

| | | | | | | | | | |
|---|---|---|---|---|---|---|---|---|---|
| 10 | 820 | 0 | | | | | 1.38 | 1.91 | 0.0054 |
| | | 45 | | | | | 2.08 | | |
| | | 90 | 230 | 405 | 37.2 | 0.0 | 2.08 | | |
| 11 | 810 | 0 | | | | | 1.39 | 1.90 | 0.0065 |
| | | 45 | | | | | 2.08 | | |
| | | 90 | 227 | 451 | 35.0 | 0.0 | 2.05 | | |
| 12 | 840 | 0 | | | | | 1.12 | 1.64 | 0.0131 |
| | | 45 | | | | | 1.92 | | |
| | | 90 | 276 | 502 | 34.2 | 0.0 | 1.58 | | |
| 13 | 840 | 0 | | | | | 1.71 | 2.13 | 0.0024 |
| | | 45 | | | | | 2.41 | | |
| | | 90 | 221 | 407 | 37.6 | 0.0 | 1.99 | | |
| 14 | 840 | 0 | | | | | 1.76 | 2.28 | 0.0042 |
| | | 45 | | | | | 2.46 | | |
| | | 90 | 239 | 390 | 37.2 | 0.0 | 2.45 | | |
| 15 | 840 | 0 | | | | | 1.74 | 2.17 | 0.0054 |
| | | 45 | | | | | 2.46 | | |
| | | 90 | 210 | 375 | 40.5 | 0.0 | 2.02 | | |
| 16 | 840 | 0 | | | | | 1.66 | 2.14 | 0.0162 |
| | | 45 | | | | | 2.35 | | |
| | | 90 | 234 | 432 | 36.3 | 0.0 | 2.21 | | |
| 17 | 830 | 0 | | | | | 1.38 | 1.91 | 0.0086 |
| | | 45 | | | | | 2.08 | | |
| | | 90 | 246 | 436 | 36.4 | 0.0 | 2.08 | | |
| 18 | 840 | 0 | | | | | 1.61 | 1.97 | 0.0078 |
| | | 45 | | | | | 1.99 | | |
| | | 90 | 280 | 447 | 38.9 | 0.0 | 2.27 | | |

| No | Average number density of TiO*x* per mm$^2$ | Surface appearance | Ar3 (° C.) | TiO*x* inclusions (%) | NbO inclusions (%) | SiO2 inclusions (%) | Total O (%) | |
|---|---|---|---|---|---|---|---|---|
| 1 | 56 | OK | 840 | 70.2 | 0.4 | 0.3 | 0.0045 | Inven. |
| 2 | 43 | OK | 865 | 67.5 | 0.5 | 0.2 | 0.0036 | Inven. |
| 3 | 35 | OK | 853 | 60.1 | 0.5 | 0.3 | 0.0034 | Inven. |
| 4 | 34 | OK | 827 | 59.7 | 0.6 | 0.4 | 0.0042 | Inven. |
| 5 | 135 | OK | 850 | 92.5 | 0.2 | 0.1 | 0.0057 | Inven. |
| 6 | 142 | OK | 860 | 95.3 | 0.1 | 0.3 | 0.0065 | Inven. |
| 7 | 43 | OK | 856 | 72.7 | 0.5 | 0.2 | 0.0023 | Inven. |
| 8 | 76 | OK | 797 | 86.2 | 0.2 | 0.3 | 0.0027 | Inven. |
| 9 | 47 | OK | 841 | 75.2 | 0.3 | 0.5 | 0.0037 | Inven. |
| 10 | 38 | OK | 854 | 68.5 | 0.4 | 0.5 | 0.0041 | Inven. |
| 11 | 94 | OK | 850 | 89.1 | 0.3 | 0.2 | 0.0033 | Inven. |
| 12 | 365 | OK | 824 | 98.2 | 0.1 | 0.2 | 0.0029 | Inven. |
| 13 | 15 | OK | 838 | 54.4 | 2.6 | 0.4 | 0.0020 | Inven. |
| 14 | 46 | OK | 848 | 74.6 | 0.3 | 0.3 | 0.0036 | Inven. |
| 15 | 95 | OK | 849 | 82.7 | 0.5 | 0.3 | 0.0031 | Inven. |
| 16 | 98 | OK | 853 | 98.1 | 0.2 | 0.3 | 0.0047 | Inven. |
| 17 | 90 | OK | 863 | 93.4 | 0.2 | 0.2 | 0.0042 | Inven. |
| 18 | 218 | OK | 867 | 99.2 | 0.1 | 0.1 | 0.0053 | Inven. |

*HR = Hot Rolling

TABLE 2

| No | C | Si | Mn | P | S | Ti | Nb | N | B | sol. Al | Other elements | Nb/Ti | HR* initial temp. (° C.) | HR* finish temp. (° C.) | Coiling temp. (° C.) |
|---|---|---|---|---|---|---|---|---|---|---|---|---|---|---|---|
| 19 | 0.0022 | 0.06 | 0.98 | 0.052 | 0.007 | 0.017 | 0.040 | 0.0022 | 0.0004 | 0.0090 | | 2.4 | 1200 | 900 | 550 |
| 20 | 0.0021 | 0.06 | 0.94 | 0.051 | 0.007 | 0.021 | 0.048 | 0.0025 | 0.0004 | 0.0420 | | 2.3 | 1190 | 930 | 550 |
| 21 | 0.0016 | 0.07 | 0.23 | 0.050 | 0.006 | 0.009 | 0.064 | 0.0024 | 0.0004 | 0.0021 | | 7.1 | 1220 | 900 | 610 |
| 22 | 0.0028 | 0.05 | 2.60 | 0.041 | 0.006 | 0.019 | 0.038 | 0.0019 | 0.0005 | 0.0018 | | 2.0 | 1210 | 900 | 420 |
| 23 | 0.0024 | 0.02 | 1.05 | 0.032 | 0.010 | 0.003 | 0.040 | 0.0050 | 0.0003 | 0.0023 | | 13.3 | 1200 | 900 | 530 |
| 24 | 0.0032 | 0.03 | 0.98 | 0.048 | 0.006 | 0.009 | 0.088 | 0.0088 | 0.0010 | 0.0042 | | 9.8 | 1200 | 900 | 550 |
| 25 | 0.0025 | 0.05 | 0.95 | 0.081 | 0.004 | 0.015 | 0.240 | 0.0018 | 0.0003 | 0.0040 | | 16.0 | 1200 | 910 | 560 |
| 26 | 0.0003 | 0.04 | 0.99 | 0.049 | 0.006 | 0.009 | 0.048 | 0.0020 | 0.0004 | 0.0012 | | 5.3 | 1200 | 910 | 550 |
| 27 | 0.0024 | 0.01 | 0.82 | 0.093 | 0.010 | 0.048 | 0.065 | 0.0019 | 0.0004 | 0.0004 | | 1.4 | 1200 | 900 | 510 |
| 28 | 0.0280 | 0.02 | 1.05 | 0.046 | 0.010 | 0.011 | 0.056 | 0.0018 | — | 0.0005 | | 5.1 | 1260 | 900 | 530 |
| 29 | 0.0039 | 0.02 | 0.96 | 0.043 | 0.006 | 0.060 | 0.030 | 0.0026 | 0.0003 | 0.0039 | | 0.5 | 1200 | 900 | 440 |
| 30 | 0.0026 | 0.02 | 0.77 | 0.140 | 0.007 | 0.012 | 0.067 | 0.0023 | 0.0004 | 0.0023 | | 5.6 | 1200 | 900 | 470 |
| 31 | 0.0032 | 0.15 | 0.98 | 0.048 | 0.006 | 0.009 | 0.088 | 0.0020 | 0.0010 | 0.0033 | | 9.8 | 1160 | 900 | 550 |

TABLE 2-continued

| | | | | | | | | | | | | | | | |
|---|---|---|---|---|---|---|---|---|---|---|---|---|---|---|---|
| 32 | 0.0024 | 0.01 | 0.82 | 0.015 | 0.034 | 0.006 | 0.017 | 0.0019 | 0.0004 | 0.0032 | | 2.8 | 1200 | 900 | 510 |
| 33 | 0.0032 | 0.04 | 1.35 | 0.049 | 0.006 | 0.015 | 0.061 | 0.0020 | 0.0004 | 0.0043 | | 4.1 | 1200 | 825 | 550 |
| 34 | | | | | | | | | | | | | 1200 | 900 | 370 |
| 35 | | | | | | | | | | | | | 1205 | 904 | 709 |

| No | Annealing temp. (° C.) | Direction (°) | YS (MPa) | TS (MPa) | EL (%) | YPE (%) | r value | $r_m$ | sol. Ti (%) |
|---|---|---|---|---|---|---|---|---|---|
| 19 | 870 | 0 | | | | | 1.03 | 1.55 | 0.0002 |
| | | 45 | | | | | 1.60 | | |
| | | 90 | 225 | 366 | 41.3 | 0.0 | 1.98 | | |
| 20 | 870 | 0 | | | | | 1.12 | 1.59 | 0.0001 |
| | | 45 | | | | | 1.70 | | |
| | | 90 | 223 | 362 | 41.3 | 0.0 | 1.85 | | |
| 21 | 850 | 0 | | | | | 1.64 | 1.86 | 0.0042 |
| | | 45 | | | | | 1.79 | | |
| | | 90 | 227 | 306 | 41.9 | 0.0 | 2.22 | | |
| 22 | 850 | 0 | | | | | 0.80 | 0.93 | 0.0042 |
| | | 45 | | | | | 0.90 | | |
| | | 90 | 399 | 450 | 22.4 | 0.0 | 1.10 | | |
| 23 | 850 | 0 | | | | | 0.98 | 1.48 | 0.0002 |
| | | 45 | | | | | 1.79 | | |
| | | 90 | 307 | 397 | 31.0 | 0.6 | 1.34 | | |
| 24 | 825 | 0 | | | | | 1.08 | 1.56 | 0.0040 |
| | | 45 | | | | | 1.75 | | |
| | | 90 | 354 | 412 | 41.4 | 0.5 | 1.65 | | |
| 25 | 840 | 0 | | | | | 0.87 | 1.57 | 0.0065 |
| | | 45 | | | | | 2.21 | | |
| | | 90 | 367 | 462 | 21.0 | 0.0 | 0.98 | | |
| 26 | 843 | 0 | | | | | 1.41 | 1.87 | 0.0056 |
| | | 45 | | | | | 1.98 | | |
| | | 90 | 168 | 309 | 37.5 | 0.0 | 2.10 | | |
| 27 | 850 | 0 | | | | | 0.78 | 1.58 | 0.0062 |
| | | 45 | | | | | 1.78 | | |
| | | 90 | 226 | 457 | 34.8 | 0.0 | 1.98 | | |
| 28 | 850 | 0 | | | | | 1.25 | 1.37 | 0.0042 |
| | | 45 | | | | | 1.32 | | |
| | | 90 | 406 | 488 | 20.1 | 0.0 | 1.60 | | |
| 29 | 850 | 0 | | | | | 1.32 | 1.46 | 0.025 |
| | | 45 | | | | | 1.10 | | |
| | | 90 | 262 | 396 | 34.7 | 0.0 | 2.30 | | |
| 30 | 850 | 0 | | | | | 1.45 | 1.81 | 0.0047 |
| | | 45 | | | | | 1.92 | | |
| | | 90 | 217 | 402 | 38.4 | 0.0 | 1.93 | | |
| 31 | 825 | 0 | | | | | 1.09 | 1.65 | 0.0054 |
| | | 45 | | | | | 1.92 | | |
| | | 90 | 360 | 479 | 25.6 | 0.0 | 1.67 | | |
| 32 | 850 | 0 | | | | | 1.35 | 1.42 | 0.0001 |
| | | 45 | | | | | 1.11 | | |
| | | 90 | 208 | 375 | 34.8 | 0.0 | 2.10 | | |
| 33 | 838 | 0 | | | | | 1.10 | 1.46 | 0.0048 |
| | | 45 | | | | | 1.72 | | |
| | | 90 | 211 | 385 | 37.1 | 0.0 | 1.30 | | |
| 34 | 821 | 0 | | | | | 1.42 | 1.50 | 0.0045 |
| | | 45 | | | | | 1.56 | | |
| | | 90 | 271 | 401 | 35.6 | 0.0 | 1.47 | | |
| 35 | 833 | 0 | | | | | 1.44 | 1.87 | 0.0043 |
| | | 45 | | | | | 2.01 | | |
| | | 90 | 172 | 324 | 35.3 | 0.0 | 2.00 | | |

| No | Average number density of TiO*x* per mm$^2$ | Surface appearance | Ar3 (° C.) | TiO*x* inclusions (%) | NbO inclusions (%) | SiO2 inclusions (%) | Total O (%) | |
|---|---|---|---|---|---|---|---|---|
| 19 | 14 | OK | 854 | 0.8 | 3.8 | 0.1 | 0.0018 | Comp. |
| 20 | 2 | OK | 855 | 0.4 | 6.2 | 0.1 | 0.0012 | Comp. |
| 21 | 59 | OK | 878 | 78.2 | 0.5 | 0.6 | 0.0043 | Comp. |
| 22 | 170 | OK | 803 | 87.8 | 0.4 | 0.4 | 0.0049 | Comp. |
| 23 | 1 | OK | 849 | 15.7 | 7.3 | 0.1 | 0.0053 | Comp. |
| 24 | 31 | OK | 850 | 76.9 | 0.3 | 0.2 | 0.0038 | Comp. |
| 25 | 123 | OK | 854 | 86.9 | 0.4 | 0.4 | 0.0039 | Comp. |
| 26 | 31 | OK | 859 | 83.7 | 0.5 | 0.2 | 0.0046 | Comp. |
| 27 | 50 | OK | 856 | 89.4 | 0.3 | 0.3 | 0.0057 | Comp. |
| 28 | 47 | OK | 825 | 79.9 | 0.4 | 0.2 | 0.0054 | Comp. |

TABLE 2-continued

| | | | | | | | | |
|---|---|---|---|---|---|---|---|---|
| 29 | 358 | streak pattern | 849 | 99.6 | 0.1 | 0.1 | 0.0064 | Comp. |
| 30 | 43 | P streaks and poor alloying | 857 | 86.5 | 0.3 | 0.2 | 0.0043 | Inven. |
| 31 | 34 | Unplated portions | 856 | 48.6 | 0.7 | 8.9 | 0.0026 | Inven. |
| 32 | 20 | Scale flaws | 856 | 45.4 | 5.2 | 0.4 | 0.0029 | Comp. |
| 33 | 42 | streak pattern | 840 | 78.5 | 0.3 | 0.2 | 0.0036 | Comp. |
| 34 | 41 | OK | | 75.0 | 0.4 | 0.2 | 0.0038 | Comp. |
| 35 | 45 | Scale flaws | | 81.5 | 0.3 | 0.2 | 0.0040 | Comp. |

(Note: Underlined are outside the range defined herein. *HR = Hot Rolling)

A 2.5-ton cast steel was manufactured using a laboratory melting apparatus and a continuous casting machine. At this time, the chemical composition of molten steel was given the same composition as obtained when undeoxidized molten steel underwent decarburization in a vacuum, and then deoxidation treatment was carried out. Deoxidation was carried out by controlled addition of elements other than Ti and then adding metallic Ti in an amount such that a desired concentration was achieved and such that $TiO_x$-type inclusions were dispersed.

Molten steel prepared by the above-described method was supplied to a one-strand vertical laboratory continuous casting machine to cast into a slab having a thickness of 100 mm and a width of 1000 mm.

The slab which was cut off was reheated, subjected to hot rolling in a laboratory hot rolling mill to obtain a thickness of 30 mm after rough rolling and a thickness of 3.2 mm after finish rolling, and then cooled. The temperature at the start and completion of hot rolling and the coiling temperature of each steel sheet obtained are shown in Table 1 and Table 2.

After cooling, each hot-rolled steel sheet was subjected to cold rolling to achieve a thickness of 0.65 mm, and the resulting thin steel sheet was sequentially subjected in a laboratory hot-dip plating apparatus to annealing (the temperature was as shown in Table 1 and Table 2), then hot-dip galvanizing to a weight of 45 g/m$^2$ per side, alloying heat treatment at 470-550° C., cooling, and temper rolling with an elongation of 0.6%.

The mechanical properties, the number of oxides, and the surface appearance of the resulting sample materials were investigated.

Mechanical properties were evaluated using a JIS No. 5 test piece taken from the thin steel sheet after annealing, and YS, TS, EL, YPE, and the r value were measured at three directions at 0°, 45°, and 90° with respect to the rolling direction. Table 1 and Table 2 show YS, TS, EL, and YPE in a direction at 90° and the r value and mean r value in directions at 0°, 45°, and 90°.

Measurement of oxides was carried out by SEM observation of a cross section of the sheet thickness at a magnification of 2000 times to determine the density of $TiO_x$ oxides. Measurement was carried out at 5 locations positioned at one-fourth of the sheet thickness t (at ¼t), and the average of the obtained results was calculated. Since the oxides which are measured may include precipitates such as oxides other than $TiO_x$ oxides, sulfides, and complex precipitates with (Nb,Ti)(C, N) or the like, the state of complex formation and particularly the concentration of Ti oxides were measured using an EDS attached to the SEM.

The surface appearance was evaluated by visual observation of the appearance of the plated surface. The surface appearance was determined to be good (OK) when plating defects such as streaky patterns, scale flaws, unplated portions, and peeling of plating were not observed.

2. Test Results

The steel compositions, the manufacturing conditions, and the results of investigation of the mechanical properties are shown in Table 1 (examples of the present invention) and Table 2 (comparative examples).

Nos. 1-18 (Table 1), which were steel sheets having compositions in the range of the present invention had good mechanical properties. In particular, these steel sheets had a value of $r_{45}$ of at least 1.80 and/or a mean r value of at least 1.60 and their surface appearance was excellent, so they were suitable for use as outer panels of automobiles.

In contrast, Nos. 19 and 20 in Table 2 had almost the same compositions as Example No. 3 of the present invention but the amount of sol. Al was changed. Because sol. Al was greater than 0.005%, the r value decreased. In addition, because Nb-based precipitates became fine, high temperature annealing at 850° C. or above was necessary.

Nos. 21-28 (Table 2) had compositions outside the range of the present invention. As a result, the mechanical properties were poor as evaluated by inadequate strength, an inadequate r value ($r_{45}$ and/or mean r value) and the occurrence of yield elongation.

No. 29 (Table 2) not only had problems with respect to mechanical properties, but due to a high Ti content, a streaky pattern developed. No. 30 (Table 2) had a high P content, leading to the occurrence of P streaks and inadequate alloying. No. 31 (Table 2) caused unplated portions to develop due to a high Si conentet. No. 32 (Table 2) had a high S content, which resulted in the occurrence of scale flaws.

No. 33, 34, and 35 (Table 2) satisfied the conditions of steel composition but did not satisfy the conditions of manufacturing process, thereby causing the mechanical properties to become poor and the r value to be inadequate. In addition, for No. 33, since the temperature at the completion of hot rolling was low, a streaky pattern developed.

Example 2

1. Preparation of a Steel Sheet 290 tons of molten steel were refined by decarburization in a converter, and the resulting undeoxidized molten steel which was contained in a ladle was transferred to an RH apparatus, where the molten steel underwent vacuum decarburization. At the end of vacuum decarburization in the RH apparatus, metallic Al was added for the purposes of preliminary deoxidation of the undeoxidized molten steel and temperature rise (heating up) of the molten steel, After addition of Al, oxygen was injected into the molten steel in the vacuum vessel at a flow rate of 38 Nm$^3$/minute in order to suitably impart heat to the molten steel by an oxidation reaction. Subsequently, in this state of the molten steel which contained oxygen, various alloying elements other than Ti were added while taking into consideration the existing concentrations of the elements, and finally Ti was added to obtain the chemical compositions shown in Table 3. In Table 3, the content of each element is in mass %, and the remainder is iron and impurities.

TABLE 3

| No. | C | Si | Mn | P | S | N | sol. Al | Ti | Nb | B | Cu | Ni | Cr | Nb/Ti |
|---|---|---|---|---|---|---|---|---|---|---|---|---|---|---|
| 1-1 | 0.0027 | 0.045 | 1.45 | 0.015 | 0.004 | 0.0034 | 0.0012 | 0.018 | 0.045 | — | — | — | — | 2.50 |
| 1-2 | 0.0032 | 0.042 | 1.47 | 0.017 | 0.005 | 0.0042 | 0.0009 | 0.021 | 0.047 | — | — | — | — | 2.24 |
| 1-3 | 0.0025 | 0.045 | 1.45 | 0.016 | 0.005 | 0.0037 | 0.0011 | 0.014 | 0.051 | — | — | — | — | 3.64 |
| 1-4 | 0.0033 | 0.047 | 1.42 | 0.015 | 0.004 | 0.0028 | 0.0009 | 0.017 | 0.055 | 0.0007 | — | — | — | 3.24 |
| 1-5 | 0.0021 | 0.062 | 1.26 | 0.048 | 0.004 | 0.0019 | 0.0007 | 0.011 | 0.068 | 0.0002 | 0.002 | 0.002 | 0.002 | 6.18 |
| 1-6 | 0.0065 | 0.055 | 1.85 | 0.051 | 0.005 | 0.0031 | 0.0011 | 0.014 | 0.082 | 0.0007 | — | — | 0.004 | 5.86 |
| 1-7 | 0.0029 | 0.044 | 1.51 | 0.043 | 0.002 | 0.0024 | 0.0005 | 0.024 | 0.077 | — | 0.12 | 0.05 | — | 3.21 |
| 1-8 | 0.0062 | 0.023 | 1.88 | 0.052 | 0.004 | 0.0024 | 0.0007 | 0.019 | 0.081 | 0.0005 | — | — | 0.08 | 4.26 |
| 1-9 | 0.0024 | 0.044 | 1.44 | 0.018 | 0.004 | 0.0034 | 0.0012 | 0.018 | 0.046 | — | — | — | — | 2.56 |
| 1-10 | 0.0027 | 0.045 | 1.45 | 0.018 | 0.006 | 0.0024 | 0.0028 | 0.009 | 0.044 | — | — | — | — | 4.89 |
| 1-11 | 0.0026 | 0.045 | 1.48 | 0.015 | 0.004 | 0.0036 | 0.0012 | 0.007 | 0.027 | — | — | 0.05 | — | 3.86 |
| 1-12 | 0.0026 | 0.045 | 1.45 | 0.017 | 0.004 | 0.0039 | 0.0012 | 0.006 | 0.024 | — | 0.12 | — | — | 4.00 |
| 1-13 | 0.0031 | 0.047 | 1.47 | 0.018 | 0.004 | 0.0034 | 0.001 | 0.007 | 0.028 | 0.0008 | — | — | 0.08 | 4.00 |

After these refining operations were completed, the ladle containing the molten steel was transported to a continuous casting machine, and a slab having a width of 960-1200 mm and a thickness of 250 mm was obtained. The slab was heated to 1250° C. in a conventional manner and subjected to hot rolling with a finishing temperature of 920° C. to a sheet thickness of 3.2 mm. The hot-rolled steel sheet was subjected to cold rolling and annealing to obtain a steel sheet with a thickness of 0.7 mm.

2. Evaluation

The front end and rear end of the resulting steel sheet were cut off and removed, and the steel sheet after removal of the ends was cut in the rolling direction and the thickness direction along the centerline in the width direction. In order to make it possible to observe the cross section formed by this cutting, a test piece for observation having a length in the rolling direction of 10 mm was cut out.

The test piece for observation was used to carry out observation and analysis of oxide-type inclusions on the cross section using an SEM/EDS, and the inclusion ratios α and β were determined, A JIS No. 5 test piece having a lengthwise direction at an angle of 45° with respect to the rolling direction was taken from this 0.7 mm-thick steel sheet, and it was subjected to a tensile test to measure the r value at 45° ($r_{45}$ value).

3. Results

Table 4 shows the inclusion ratios α and β and the $r_{45}$ value. It was confirmed that the $r_{45}$ value was at least 2.0 when inclusion ratio α was at least 0.80 and inclusion ratio β was at least 0.65.

TABLE 4

| No. | α | β | $N_{Ti}$ per mm$^2$ | $N_{Total}$ per mm$^2$ | $r_{45}$ | $r_0$ | $r_{90}$ | Mean r value | TS (MPa) |
|---|---|---|---|---|---|---|---|---|---|
| 1-1 | 0.81 | 0.79 | 85 | 108 | 2.0 | 1.4 | 1.7 | 1.8 | 362 |
| 1-2 | 0.87 | 0.84 | 124 | 147 | 2.1 | 1.4 | 1.6 | 1.8 | 369 |
| 1-3 | 0.91 | 0.85 | 75 | 88 | 2.4 | 1.4 | 1.5 | 1.9 | 363 |
| 1-4 | 0.89 | 0.79 | 86 | 109 | 2.1 | 1.5 | 1.5 | 1.8 | 361 |
| 1-5 | 0.87 | 0.80 | 168 | 210 | 2.0 | 1.3 | 2.0 | 1.8 | 404 |
| 1-6 | 0.86 | 0.77 | 172 | 223 | 2.0 | 1.2 | 1.8 | 1.8 | 453 |
| 1-7 | 0.86 | 0.73 | 144 | 198 | 2.0 | 1.2 | 1.7 | 1.7 | 439 |
| 1-8 | 0.81 | 0.84 | 129 | 154 | 2.0 | 1.1 | 1.8 | 1.7 | 465 |
| 1-9 | 0.47 | 0.45 | 61 | 137 | 1.6 | 1.2 | 1.4 | 1.5 | 364 |
| 1-10 | 0.51 | 0.45 | 48 | 107 | 1.7 | 1.2 | 1.5 | 1.5 | 368 |
| 1-11 | 0.83 | 0.45 | 45 | 100 | 1.6 | 1.1 | 1.6 | 1.5 | 388 |

TABLE 4-continued

| No. | α | β | $N_{Ti}$ per mm$^2$ | $N_{Total}$ per mm$^2$ | $r_{45}$ | $r_0$ | $r_{90}$ | Mean r value | TS (MPa) |
|---|---|---|---|---|---|---|---|---|---|
| 1-12 | 0.91 | 0.63 | 85 | 136 | 1.6 | 1.2 | 1.6 | 1.5 | 392 |
| 1-13 | 0.80 | 0.58 | 86 | 148 | 1.7 | 1.1 | 1.6 | 1.5 | 402 |

Example 3

In the same manner as in Example 2, 290 tons of molten steel underwent decarburization refining in a converter, and the resulting undeoxidized molten steel contained in a ladle was transferred to an RH apparatus, where the molten steel was subjected to vacuum decarburization. At the end of vacuum decarburization in the RH apparatus, metallic Al was added for the purposes of preliminary deoxidation of the undeoxidized molten steel and temperature rise of the molten steel. After addition of Al, oxygen was injected into the molten steel in the vacuum vessel at a flow rate of 38 Nm$^3$/minute in order to suitably impart heat to the molten steel by an oxidation reaction. Subsequently, in this state of the molten steel which contained oxygen, its oxygen concentration was measured by an oxygen concentration sensor based on the principle of an oxygen concentration cell employing a stabilized zirconia solid electrolyte. In the state of the molten steel which still contained oxygen, various alloying elements other than Ti were added while taking into consideration the existing concentrations of the elements, and finally Ti was added. The composition of the molten steel after this composition adjustment treatment is shown in Table 5. In Table 5, the content of each element is in mass %, and the remainder is iron and impurities.

In order to determine the sol. Ti concentration in the molten steel after this treatment, a sample was collected by scooping into an iron bomb. A cross section of the solidified bomb sample was polished to a mirror finish, and the number of inclusions in each of various compositions was investigated using an SEM equipped with an EDS.

The results are shown in Table 6. In Examples 2-1 and 2-2, the dissolved oxygen concentration is in the range from 0.003% to 0.018%. It can be seen that by subsequent addition of Ti such that the sol. Ti concentration is in the range of 0.004%-0.04%, the ratios α and β which are related to the amount of $TiO_x$ oxides can be controlled to a desired range.

TABLE 5

| No. | C | Si | Mn | P | S | N | sol. Al | Ti | Nb | B | Nb/Ti |
|---|---|---|---|---|---|---|---|---|---|---|---|
| 2-1 | 0.0026 | 0.042 | 1.42 | 0.016 | 0.005 | 0.0034 | 0.0009 | 0.019 | 0.045 | — | 2.37 |
| 2-2 | 0.0031 | 0.045 | 1.47 | 0.017 | 0.005 | 0.0042 | 0.0015 | 0.021 | 0.048 | 0.0005 | 2.29 |
| 2-3 | 0.0028 | 0.044 | 1.45 | 0.016 | 0.004 | 0.0037 | 0.0011 | 0.014 | 0.051 | — | 3.64 |
| 2-4 | 0.0024 | 0.048 | 1.42 | 0.016 | 0.004 | 0.0029 | 0.0017 | 0.016 | 0.055 | 0.0007 | 3.44 |
| 2-5 | 0.0024 | 0.044 | 1.44 | 0.018 | 0.004 | 0.0034 | 0.0012 | 0.014 | 0.056 | — | 4.00 |
| 2-6 | 0.0027 | 0.045 | 1.45 | 0.018 | 0.006 | 0.0024 | 0.0028 | 0.009 | 0.043 | — | 4.78 |

TABLE 6

| No. | Dissolved oxygen before Ti addition (mass %) | [sol. Ti] after Ti addition (mass %) | [Ti] in steel sheet (mass %) | $N_{Ti}$ (/mm$^2$) | $N_{Al}$ (/mm$^2$) | $N_{Total}$ (/mm$^2$) | Inclusion ratio α | Inclusion ratio β | Remarks |
|---|---|---|---|---|---|---|---|---|---|
| 2-1 | 0.0052 | 0.011 | 0.017 | 91 | 21 | 119 | 0.81 | 0.76 | Inventive |
| 2-2 | 0.0166 | 0.005 | 0.01 | 84 | 17 | 112 | 0.83 | 0.75 | Inventive |
| 2-3 | 0.0028 | 0.012 | 0.016 | 54 | 31 | 94 | 0.64 | 0.57 | Comparative |
| 2-4 | 0.0201 | 0.004 | 0.014 | 47 | 10 | 78 | 0.82 | 0.6 | Comparative |
| 2-5 | 0.0074 | 0.0044 | 0.051 | 70 | 11 | 93 | 0.86 | 0.75 | Comparative |
| 2-6 | 0.00169 | 0.002 | 0.006 | 17 | 24 | 87 | 0.41 | 0.2 | Comparative |

In contrast, Comparative Examples 2-3 and 2-4 are cases in which the dissolved oxygen concentration was outside the prescribed range, and Comparative Examples 2-5 and 2-6 are cases in which the dissolved oxygen concentration was inside the prescribed range but the subsequent sol. Ti concentration was outside the claimed range. In either case, the ratios α and β, which are related to the amount of $TiO_x$ oxides, or the Ti concentration of the product were outside the claimed range, and controllability was inferior.

The invention claimed is:

1. A cold-rolled steel sheet characterized by having a chemical composition consisting of, in mass percent, C: 0.0005-0.025%, Si: at most 0.2%, Mn: 0.3-2.5%, P: at most 0.15%, S: at most 0.02%, N: at most 0.006%, sol. Al: 0.0001 to less than 0.005%, Ti: 0.005-0.05%, Nb: 0.020-0.200%, and optionally one or more elements selected from the group consisting of B: at most 0.0020%, Cr: at most 1%, Mo: at most 1%, V: at most 1%, W: at most 1%, Cu: at most 1%, and Ni: at most 1%, with the mass ratio (Nb/Ti) of the contents of Nb and Ti being at least 2, sol. Ti: 0.004% or more, and a remainder of Fe and impurities, and by having an r value in a direction at 45° with respect to the rolling direction ($r_{45}$) of at least 1.80 and/or a mean r value ($r_m$) of at least 1.60, along with a tensile strength of at least 340 MPa, wherein a dissolved oxygen concentration ranges between 0.003 and 0.018% in a molten steel used to make the steel sheet, the dissolved oxygen concentration measured prior to addition of Ti to the molten steel.

* * * * *